US009908653B2

(12) United States Patent
Izumida

(10) Patent No.: US 9,908,653 B2
(45) Date of Patent: Mar. 6, 2018

(54) PAPER SHEET PROCESSING DEVICE

(71) Applicant: GLORY LTD., Himeji-shi, Hyogo (JP)

(72) Inventor: Tsuyoshi Izumida, Hyogo (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/124,879

(22) PCT Filed: Mar. 4, 2015

(86) PCT No.: PCT/JP2015/001148
§ 371 (c)(1),
(2) Date: Sep. 9, 2016

(87) PCT Pub. No.: WO2015/141162
PCT Pub. Date: Sep. 24, 2015

(65) Prior Publication Data

US 2017/0073101 A1 Mar. 16, 2017

(30) Foreign Application Priority Data

Mar. 19, 2014 (CN) ..... 2014 2 0125040 U

(51) Int. Cl.

| | |
|---|---|
| ***B65H 31/10*** | (2006.01) |
| ***B65B 57/16*** | (2006.01) |
| ***G07D 11/00*** | (2006.01) |
| ***B65B 13/06*** | (2006.01) |
| ***B65B 13/20*** | (2006.01) |
| ***B65B 13/32*** | (2006.01) |
| ***B65B 27/08*** | (2006.01) |
| ***B65H 31/38*** | (2006.01) |

(52) U.S. Cl.
CPC ..... *B65B 57/16* (2013.01); *B65B 13/06* (2013.01); *B65B 13/20* (2013.01); *B65B 13/32* (2013.01); *B65B 27/08* (2013.01); *B65H 31/10* (2013.01); *B65H 31/38* (2013.01); *G07D 11/00* (2013.01); *G07D 11/0018* (2013.01); *B65H 2301/4223* (2013.01); *B65H 2402/45* (2013.01)

(58) Field of Classification Search
CPC ..... B65B 57/16; B65B 13/32; B65B 27/08; B65B 13/06; B65B 13/20; G07D 11/0018; G07D 11/00; B65H 31/3036; B65H 31/3045; B65H 33/06
See application file for complete search history.

(56) References Cited

U.S. PATENT DOCUMENTS

2013/0047869 A1 2/2013 Kataoka et al.

FOREIGN PATENT DOCUMENTS

JP 6-144687 A 5/1994
JP 11-236160 A 8/1999
(Continued)

*Primary Examiner* — David H Bollinger
(74) *Attorney, Agent, or Firm* — Renner, Kenner, Greive, Bobak, Taylor & Weber

(57) ABSTRACT

Disclosed herein is a banknote handling apparatus 100 including a bundling stacker 4 configured to stack banknotes B therein. The bundling stacker 4 includes: a stage 41 configured to support the banknotes B in their thickness direction; and a guide 42 facing one side of the banknotes B and configured to regulate movement of the banknotes B in a predetermined regulation direction which is parallel to a surface of the banknotes B. The guide 42 moves such that while the banknotes B are removed from the bundling stacker 4, a gap G is formed in the regulation direction between the guide 42 and the one side of the banknotes B.

12 Claims, 9 Drawing Sheets

(56) References Cited

FOREIGN PATENT DOCUMENTS

| | | | |
|---|---|---|---|
| JP | 2002-197509 | A | 7/2002 |
| JP | 2005-157761 | | 6/2005 |
| JP | 2005-157761 | A | 6/2005 |
| JP | 2007-99430 | A | 4/2007 |

PAPER SHEET PROCESSING DEVICE

TECHNICAL FIELD

The present disclosure relates to a paper sheet processing device.

BACKGROUND ART

Paper sheet processing devices including a stacking unit that stacks paper sheets have heretofore been known in the art. For example, the paper sheet processing device disclosed in Patent Document 1 is configured to count paper sheets, temporarily stack the counted paper sheets in a stacking unit, and then bundle the stacked paper sheets together on a predetermined number basis.

CITATION LIST

Patent Document

PATENT DOCUMENT 1: Japanese Unexamined Patent Publication No. 2002-197509

SUMMARY OF INVENTION

Technical Problem

In such a configuration in which paper sheets are stacked in a stacking unit, sometimes the operator needs to remove the paper sheets from the stacking unit. For example, if any paper sheets yet to be bundled remain in the stacking unit even when the processing of the paper sheets is completed or if any abnormality has occurred during the processing, the paper sheets may need to be removed from the stacking unit.

On the other hand, the stacking unit is provided with a guide or any other suitable regulating member configured to regulate the movement of paper sheets and align the paper sheet neatly. That is why when the paper sheets are removed from the stacking unit, the guide and other members will interfere with the removal, resulting in unsatisfactory work efficiency.

In view of the foregoing background, it is therefore an object of the present disclosure to improve the efficiency with which paper sheets are removed from the stacking unit.

Solution to the Problem

The present disclosure provides a paper sheet processing device including a stacking unit configured to stack paper sheets therein. The stacking unit includes: a stage configured to support the paper sheets in their thickness direction; and a guide facing one side of the paper sheets and configured to regulate movement of the paper sheets in a predetermined regulation direction which is parallel to a surface of the paper sheets. The guide moves such that while the paper sheets are removed from the stacking unit, a gap is formed in the regulation direction between the guide and the one side of the paper sheets.

According to this configuration, while paper sheets are being stacked, the paper sheets are supported by a stage in their thickness direction, and their movement in a predetermined regulation direction parallel to a surface of the paper sheets is regulated by a guide. Thus, the paper sheets are aligned neatly on the stage in the stacking unit.

In general, if the paper sheets are stacked neatly in this manner, there will be either no gap, or only a narrow gap if any, between one side of the paper sheets facing the guide and the guide. That is why while the paper sheets are removed from the stacking unit, the guide will often interfere with the removal work, resulting in lower work efficiency. In contrast, the guide of this device moves in the regulation direction so as to leave a gap between the guide and the paper sheets while the paper sheets are being removed. As a result, there will be no friction between the paper sheets and the guide, and the paper sheets are allowed to move in the regulation direction. Thus, the removal work may be done with improved efficiency.

In one embodiment, the regulation direction may be one of two directions that are respectively (i) parallel to longer edges of the paper sheets and (ii) parallel to shorter edges of the paper sheets, and the stacking unit may have an outlet configured to remove the paper sheets in a removal direction that is one of the two directions that are respectively (i) parallel to the longer edges of the paper sheets and (ii) parallel to the shorter edges of the paper sheets. The removal direction is different from the regulation direction.

According to this configuration, the removal direction of the paper sheets is perpendicular to the paper sheet regulation direction defined by the guide. For example, if the removal direction is the direction parallel to longer edges of the paper sheets, the guide faces one of the longer edges of the paper sheets and regulates the movement of the paper sheets in the direction parallel to the shorter edges thereof. In that case, almost no gap is left between the one longer edge of the paper sheets and the guide. Thus, while the paper sheets are being removed, the guide moves so as to leave a gap between the guide itself and the one longer edge of the paper sheets. As a result, there will be no friction between the paper sheets and the guide, and the paper sheets are allowed to move in the regulation direction, which thus facilitates removing the paper sheets. Likewise, if the removal direction is the direction parallel to shorter edges of the paper sheets, the guide faces one of the shorter edges of the paper sheets and regulates the movement of the paper sheets in the direction parallel to the longer edges thereof. In that case, almost no gap is left between the one shorter edge of the paper sheets and the guide. Thus, while the paper sheets are being removed, the guide moves so as to leave a gap between the guide itself and the one shorter edge of the paper sheets. As a result, there will be no friction between the paper sheets and the guide, and the paper sheets are allowed to move in the regulation direction, which thus facilitates removing the paper sheets.

In another embodiment, the regulation direction may correspond with a transport direction in which the paper sheets are transported to the stacking unit.

According to this configuration, the paper sheets are transported to the stacking unit while having some momentum in the transport direction. Since the paper sheet regulation direction defined by the guide corresponds with the transport direction, the movement of the paper sheets in the transport direction is regulated by the guide. Thus, even if the paper sheets are transported to the stacking unit while having some momentum in the transport direction, the paper sheets may still be aligned in the transport direction in the stacking unit.

In still another embodiment, the stacking unit may be provided with a door configured to close the outlet while the paper sheets are being stacked and to open the outlet while the paper sheets are being removed.

According to this configuration, the outlet is closed with the door shut when the paper sheets are stacked but is opened with the door opened when the paper sheets are removed.

In yet another embodiment, the door may regulate the movement of the paper sheets in the removal direction while the paper sheets are being stacked.

According to this configuration, the movements of the paper sheets in the two directions respectively parallel to their longer and shorter edges are regulated by the guide and the door. This thus facilitates aligning and stacking the paper sheets neatly.

In yet another embodiment, the stage may be configured to adjust a stacking space for the paper sheets by moving in the thickness direction of the paper sheets. While the paper sheets are being stacked, as the paper sheets are stacked in increasing numbers, the stage may move in the thickness direction of the paper sheets toward one of two sides that expands the stacking space. On the other hand, while the paper sheets are being removed, the stage may move in the thickness direction of the paper sheets toward that one side that further expands the stacking space from its position while the paper sheets are being stacked.

According to this configuration, the stage moves according to the number of paper sheets stacked, thereby adjusting the stacking space. Specifically, as the paper sheets are stacked in increasing numbers, the stacking space is expanded. On the other hand, while the paper sheets are being removed, the stage moves toward that one side that further expands the stacking space from its position while the paper sheets are being stacked. That is to say, while the paper sheets are being removed, the stacking space is expanded, thus giving the operator a space to insert his or her fingers, for example, during the paper sheet removal work. As a result, the work may be done with improved efficiency.

In yet another embodiment, the guide may change its position in the regulation direction according to the kind of the paper sheets while the paper sheets are being stacked.

According to this configuration, the position of the guide in the regulation direction is not fixed irrespective of the kind of the paper sheets, but is adjusted according to the kind of the paper sheets. Specifically, since the dimensions of the paper sheets change according to the kind of the paper sheets, the position of the guide is adjusted according to the dimension of the paper sheets measured in one of the two directions respectively parallel to the longer and shorter edges thereof which corresponds with the regulation direction. Thus, the paper sheets may be stacked neatly irrespective of the kind of the paper sheets.

In yet another embodiment, the paper sheet processing device may further include a bundling unit configured to bundle the paper sheets stacked in the stacking unit.

That is to say, the stacking unit is a place where the paper sheets are stacked before the paper sheets are bundled together by the bundling unit. According to such a configuration, if the paper sheets yet to be bundled remain in the stacking unit even when the processing of the paper sheets is completed or if any abnormality has occurred during the processing, the paper sheets may be removed from the stacking unit.

Advantages of the Invention

This paper sheet processing device allows paper sheets to be removed from the stacking unit with improved work efficiency.

DESCRIPTION OF EMBODIMENTS

Exemplary embodiments will now be described in detail with reference to the drawings.

First Embodiment

<General Configuration for Banknote Handling Apparatus>

Figure 1:
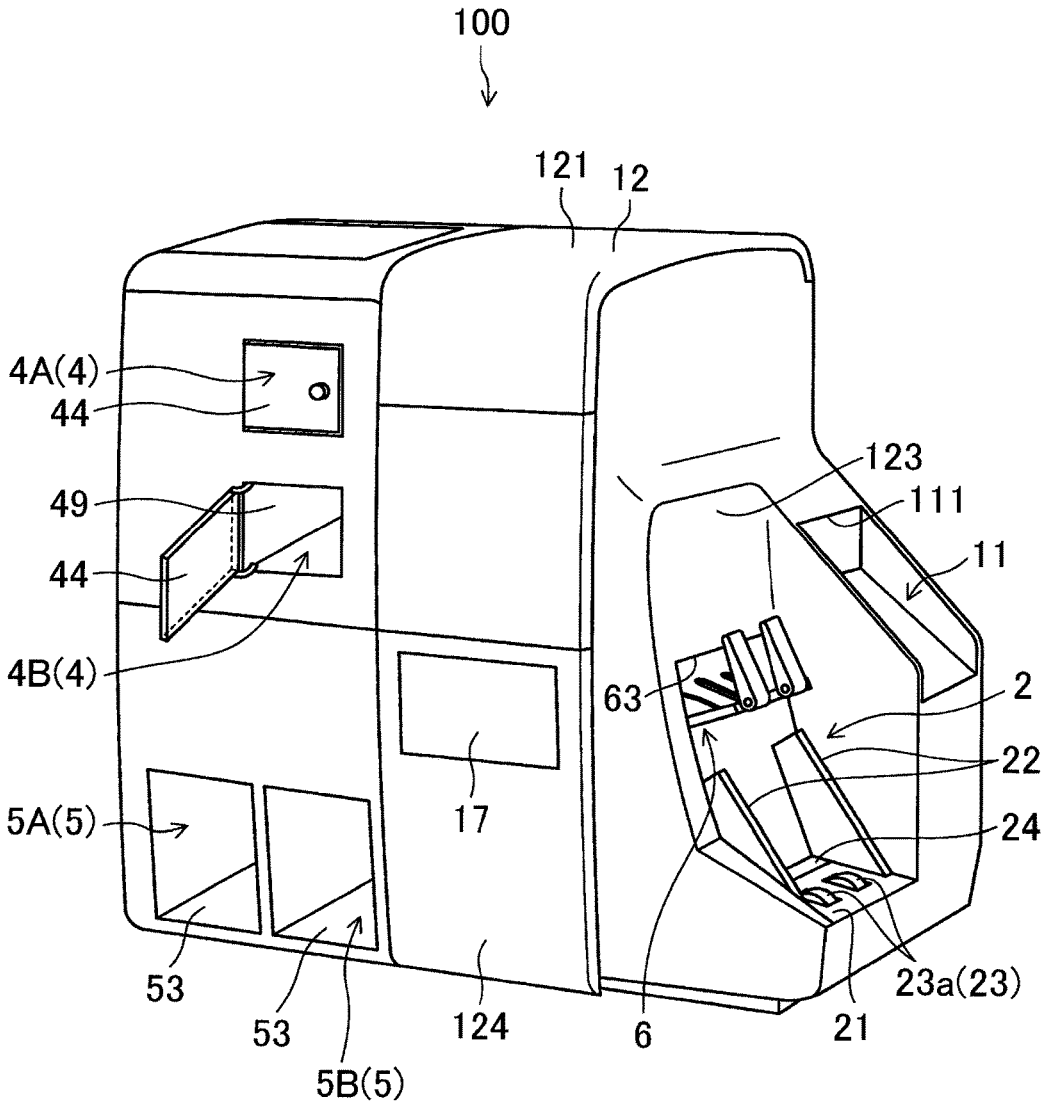
FIG. 1 is a view illustrating the appearance of a banknote handling apparatus.
Figure 2:
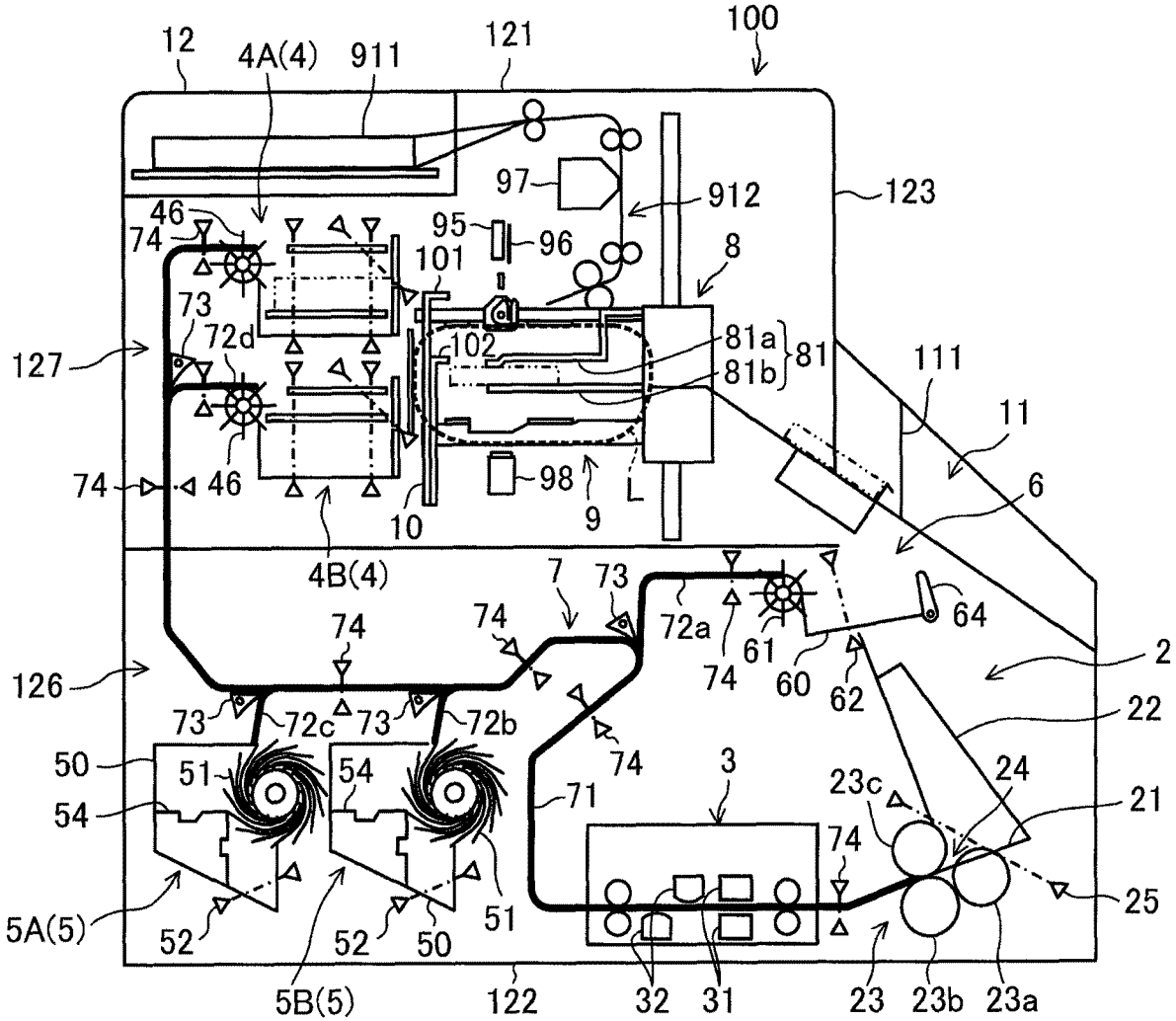
FIG. 2 illustrates a general configuration for the banknote handling apparatus.

FIG. 1 illustrates the appearance of a banknote handling apparatus 100, and FIG. 2 illustrates a general configuration for the banknote handling apparatus 100.

The banknote handling apparatus 100 is placed on a teller counter of a bank, for example, and is used by an operator. The banknote handling apparatus 100 takes loose banknotes therein, stacks the banknotes of a predetermined kind, bundles the banknotes in a predetermined bundling number, and dispenses the bundled banknotes. The banknote handling apparatus 100 is an exemplary paper sheet processing device, and banknotes are an example of paper sheets.

The banknote handling apparatus 100 includes a hopper unit 2 which takes the banknotes placed thereon into the apparatus, a recognition unit 3 which recognizes the banknotes, bundling stackers 4 which stack the banknotes to be bundled, non-bundling stackers 5 which stack the banknotes not to be bundled, a reject stacker 6 which stacks rejected banknotes, a first transport unit 7 which transports the banknotes taken in through the hopper unit 2 to the recognition unit 3, the bundling stackers 4, the non-bundling stackers 5, and the reject stacker 6, a second transport unit 8 which transports the banknotes stacked in the bundling stackers 4 to the predetermined position, a bundling unit 9 which bundles the banknotes transported by the second transport unit 8, a third transport unit 10 which transports the banknotes that have been bundled (hereinafter referred to as "bundled banknotes"), a dispense unit 11 through which the bundled banknotes are dispensed, and a box-shaped housing 12 which houses the recognition unit 3, the bundling stackers 4, the non-bundling stackers 5, the reject stacker 6, the first transport unit 7, the second transport unit 8, the bundling unit 9, and the third transport unit 10.

The housing 12 has a top surface 121, a bottom surface 122, and four side surfaces. The housing 12 is a desktop type housing. That is to say, the bottom surface 122 of the housing 12 is not provided with casters or any other similar parts, and thus the housing 12 is configured to be placed on the desk.

The hopper unit 2 and the dispense unit 11 are provided through a first side surface 123, which is one of the four side surfaces of the housing 12. First outlets 49 of the bundling stackers 4 and second outlets 53 of the non-bundling stackers 5, which will be described in detail later, are provided through a second side surface 124, which is another one of the four side surfaces. The first and second side surfaces 123 and 124 are adjacent to each other.

The space inside the housing 12 is divided into a first handling section 126 configured to perform various kinds of handling processing for recognizing and sorting the banknotes and a second handling section 127 configured to perform various kinds of handling processing for bundling the banknotes to be bundled. The second handling section 127 is provided above the first handling section 126. The first handling section 126 includes the hopper unit 2, the recognition unit 3, the non-bundling stackers 5, and the reject stacker 6. The second handling section 127 includes the bundling stackers 4, the second transport unit 8, the bundling unit 9, and the third transport unit 10. Most of the first transport unit 7 is included in the first handling section 126.

The bundling stackers 4 include two stackers, namely, a first bundling stacker 4A and a second bundling stacker 4B. Both of the first and second bundling stackers 4A and 4B stack the banknotes to be bundled. The banknotes stacked as those to be bundled are determined as appropriate. The banknotes to be bundled are banknotes of a predetermined kind. The predetermined kind is identified by denomination or the orientation of the banknotes, or by determining whether the banknotes are fit or unfit, whether the banknotes are facing up or down, or whether the banknotes are new or not, for example. In this example, the banknotes to be bundled are fit banknotes of a predetermined denomination (e.g., 100 Chinese Yuan). In the following description, the banknotes which are recognized as normal by the recognition unit 3 will be hereinafter referred to as "normal banknotes," the banknotes which are not recognized as normal by the recognition unit 3 will be hereinafter referred to as "abnormal banknotes," and the banknotes which are transported in an abnormal state, e.g., skewed or multi-fed, will be hereinafter referred to as "abnormally transported banknotes." For example, one of the conditions for determining whether the banknotes are normal or not is whether the serial numbers of the banknotes are distinguishable or not. However, the normality of the banknotes may be checked based on a different condition, or an additional condition may be applied to determine whether the banknotes are normal or not. The banknotes which are determined as the normal banknotes but the destination of which (the bundling stacker, the non-bundling stacker, or other stackers) is not designated will be hereinafter referred to as "undesignated banknotes." Among the normal banknotes, those which are not stained or torn significantly will be hereinafter referred to as "fit banknotes," and those which are stained or torn significantly will be hereinafter referred to as "unfit banknotes." The bundling stacker 4 is an exemplary stacking unit.

The first and second bundling stackers 4A and 4B are arranged substantially vertically, i.e., one on top of the other, in the second handling section 127. The first bundling stacker 4A is positioned over the second bundling stacker 4B. The first and second bundling stackers 4A and 4B have the same configuration. When it is not necessary to distinguish the two stackers from each other, they will be hereinafter referred to as "bundling stackers 4." A detailed configuration of the bundling stackers 4 will be described later.

The non-bundling stackers 5 include two stackers, namely, a first non-bundling stacker 5A and a second non-bundling stacker 5B. The first and second non-bundling stackers 5A and 5B are arranged substantially horizontally, i.e., side by side, in the first handling section 126. The second non-bundling stacker 5B is arranged closer to the hopper unit 2 than the first non-bundling stacker 5A is. When it is not necessary to distinguish the two stackers from each other, they will be hereinafter referred to as "non-bundling stackers 5." A detailed configuration of the non-bundling stackers 5 will be described later. The banknotes to be stacked in the non-bundling stackers 5 may be determined as appropriate. Here, the first non-bundling stacker 5A stacks unfit banknotes of the predetermined denomination. The second non-bundling stacker 5B stacks banknotes of every denomination but the predetermined denomination.

The reject stacker 6 stacks the rejected banknotes. The reject stacker 6 is positioned closer to the hopper unit 2 than the first and second non-bundling stackers 5A and 5B are. The reject stacker 6 is positioned at a level slightly higher than the first and second non-bundling stackers 5A and 5B. A detailed configuration of the reject stacker 6 will be described later. The banknotes to be stacked in the reject stacker 6 may be determined as appropriate. Here, the reject stacker 6 stacks "undesignated banknotes," "abnormal banknotes," and "abnormally transported banknotes" as the rejected banknotes.

The hopper unit 2 is provided for a portion of the first side surface 123 corresponding to the first handling section 126, and the dispense unit 11 is provided in a portion of the first side surface 123 corresponding to the second handling section 127.

The hopper unit 2 includes a mount 21 on which banknotes are placed, two guides 22, 22 which guide the banknotes placed on the mount 21, intake rollers 23, an inlet 24 through which the banknotes are taken in, and a banknote sensor 25 which detects the banknotes on the mount 21. In the present embodiment, the banknotes are placed on the hopper unit 2 such that the banknotes are taken in in a direction parallel to their shorter edges.

As shown in FIG. 1, the inlet 24 is arranged at a corner where the mount 21 and the first side surface 123 intersect with each other. The mount 21 is tilted such that the closer to the inlet 24, the lower the level of the mount 21. Thus, the banknotes on the mount 21 go toward the inlet 24 by themselves. The banknotes placed on the mount 21 are taken into the housing 12 through the inlet 24.

The banknote sensor 25 is provided near the inlet 24. The banknote sensor 25 includes a transmitter which emits light and a receiver which receives the light, and detects the banknotes when the light emitted from the transmitter toward the receiver is blocked. First and second banknote sensors 47 and 48, stacking sensors 52 and 62, tracking sensors 74, and first and second tape sensors 9210 and 9211 to be described later are also configured in the same manner.

The banknote sensor 25 is arranged such that the light is blocked by the banknotes placed on the mount 21. That is to say, the banknote sensor 25 can detect that the banknotes are placed on the mount 21 when the light is blocked.

The guides 22, 22 are configured such that the interval between them is adjustable. Specifically, the interval between the guides 22, 22 is adjusted according to the banknotes placed on the mount 21.

The intake rollers 23 include kicker rollers 23*a*, feed rollers 23*b*, and gate rollers 23*c*. The kicker rollers 23*a* are partially exposed from the mount 21, and are in contact with the lowermost one of the banknotes placed on the mount 21. The kicker rollers 23*a* feed the lowermost one of the banknotes on the mount 21 to the inlet 24. Thus, the banknotes are taken in through the inlet 24 one by one. The banknotes taken in through the inlet 24 are distributed one by one by the feed rollers 23*b* and the gate rollers 23*c* into the housing 12. The banknotes thus taken in are passed to the first transport unit 7.

The dispense unit 11 includes a dispense port 111 through which the bundled banknotes are dispensed. In the dispense unit 11, the bundled banknotes are dispensed through the dispense port 111 in the direction parallel to their shorter edges.

The first transport unit 7 may be configured as a transport belt or any other suitable member. The first transport unit 7 includes a main transport path 71, first to fourth diverged paths 72*a* to 72*d* diverged from the main transport path 71, sorting mechanisms 73 provided at junctions between the main transport path 71 and the diverged paths, and a plurality of tracking sensors 74 which detect the passage of the banknotes. The first transport unit 7 transports the banknotes in the direction parallel to their shorter edges. The first transport unit 7 is an exemplary transport unit.

The main transport path 71 extends from the intake rollers 23 through the first bundling stacker 4A. The first diverged path 72*a* is the most upstream path in the main transport path 71, and the second, third, and fourth diverged paths 72*b*, 72*c* and 72*d* are arranged in this order downstream of the first diverged path 72*a*. When it is not necessary to distinguish the first to fourth diverged paths 72*a* to 72*d* from each other, they will be hereinafter referred to as "diverged paths 72." The first diverged path 72*a* extends to reach the reject stacker 6. The second diverged path 72*b* extends to reach the second non-bundling stacker 5B. The third diverged path 72*c* extends to reach the first non-bundling stacker 5A. The fourth diverged path 72*d* extends to reach the second bundling stacker 4B.

The sorting mechanisms 73 are driven by a solenoid (not shown). Each of the sorting mechanisms 73 sorts the banknotes transported through the main transport path 71 depending on whether they need to be diverged to an associated one of the diverged paths 72 or not. A tracking sensor 74 is provided upstream of each of the sorting mechanisms 73. The tracking sensors 74 are configured in the same manner as the banknote sensor 25. That is, the tracking sensors 74 can detect the passage of the banknotes if the reception of light by the receiver of the tracking sensor 74 is temporarily interrupted and then resumed. In guiding the banknotes to the diverged path 72, each sorting mechanism 73 is turned ON as soon as the tracking sensor 74 immediately upstream thereof detects the passage of the banknotes.

The recognition unit 3 is provided on the main transport path 71 upstream of the first diverged path 72*a*. The recognition unit 3 is configured to recognize each of the banknotes being transported in terms of their denomination, authenticity, and fitness. Specifically, the recognition unit 3 includes a line sensor 31 and a magnetic sensor 32, and detects the feature of each banknote. The recognition unit 3 determines whether the feature of the banknote thus detected corresponds with any of the features of the banknotes stored, thereby making a determination about their denomination, authenticity, and fitness.

The recognition unit 3 does not always include the line sensor and the magnetic sensor, but may include any other suitable sensor such as an infrared sensor or an ultraviolet sensor as long as they can detect the features of the banknotes. The line sensor 31 also has the function of optically reading the serial numbers printed on the banknotes. Note that a control unit 120 to be described later may have all of the functions of the recognition unit 3 but the detecting function.

The bundling unit 9 bundles the stacked banknotes. As will be described in detail later, the bundling unit 9 forms a tape loop L from a tape, and rewinds the tape after the banknotes have been transported into the tape loop L so that the banknotes are bundled with the tape.

The second transport unit 8 grips the banknotes stacked in the bundling stacker 4 to transport the banknotes into the tape loop L. The second transport unit 8 includes a gripper 81 which grips the banknotes, a first horizontal displacement mechanism which displaces the gripper 81 in the horizontal direction parallel to the shorter edges of the banknotes (this direction will be hereinafter referred to as a "first horizontal direction"), a second horizontal displacement mechanism which displaces the gripper 81 in the horizontal direction parallel to the longer edges of the banknotes (hereinafter referred to as a "second horizontal direction"), and a vertical displacement mechanism which displaces the gripper 81 in the vertical direction. The second transport unit 8 is an exemplary paper sheet transport unit.

The gripper 81 includes an upper arm 81*a*, a lower arm 81*b* facing the upper arm 81*a*, and a gripping mechanism which displaces the upper arm 81*a* in the vertical direction. The upper arm 81*a* includes three fingers extending parallel to each other and a coupling portion which couples the three fingers together. Likewise, the lower arm 81*b* also has three fingers extending parallel to each other and a coupling portion which couples the three fingers together. The gripping mechanism supports the upper arm 81*a* so that the upper arm 81*a* is movable in the vertical direction, and moves the upper arm 81*a* in the vertical direction using a motor and a drive belt. This configuration allows the upper and lower arms 81*a* and 81*b* to grip the banknotes.

The first horizontal displacement mechanism supports the gripper 81 so that the gripper 81 is movable in the first horizontal direction, and displaces the gripper 81 in the first horizontal direction using the motor and the drive belt.

The vertical displacement mechanism supports the first horizontal displacement mechanism so that the first horizontal displacement mechanism is movable in the vertical direction, and displaces the first horizontal displacement mechanism in the vertical direction using the motor and the drive belt.

The second horizontal displacement mechanism supports the vertical displacement mechanism so that the vertical displacement mechanism is movable in the second horizontal direction, and displaces the vertical displacement mechanism in the second horizontal direction using the motor and the drive belt.

Thus, the gripper 81 is configured to be readily moved along three orthogonal axes by the first and second horizontal displacement mechanisms and the vertical displacement mechanism.

The third transport unit 10 transports the bundled banknotes to the dispense unit 11. The third transport unit 10 includes an upper gripping part 101, a lower gripping part 102, and a horizontal displacement mechanism which displaces the upper and lower gripping parts 101 and 102 in the first horizontal direction. In displacing the upper gripping part 101 in the first horizontal direction, the horizontal displacement mechanism displaces the upper gripping part 101 in the vertical direction, too. That is, the third transport unit 10 is configured to pass beside the bundling unit 9 in the first horizontal direction. When the third transport unit 10 is positioned opposite to the dispense unit 11 relative to the bundling unit 9, the upper gripping part 101 is positioned over, and sufficiently distant from, the lower gripping part 102. The upper gripping part 101 moves downward from this position as it approaches the bundled banknotes in the bundling unit 9. Then, when the upper gripping part 101 reaches the bundled banknotes, the bundled banknotes are gripped by the upper and lower gripping parts 101 and 102. The upper and lower gripping parts 101 and 102 transport the bundled banknotes to the vicinity of the dispense unit 11 while gripping them. In the vicinity of the dispense unit 11, the upper gripping part 101 moves upward as it approaches the dispense unit 11. As a result, the bundled banknotes gripped by the upper and lower gripping parts 101 and 102 are released from the upper and lower gripping parts 101 and 102 at the dispense unit 11, and are dispensed to the dispense unit 11.

On the second side surface 124 of the housing 12, as shown in FIG. 1, a touch panel 17 is provided to serve as an operating unit through which information is entered into the banknote handling apparatus 100 and as a display unit which displays information about the banknote handling apparatus 100. The touch panel 17 is a human interface for the operator who operates this banknote handling apparatus 100.

<Configuration of Bundling Stacker 4>

Figure 3:
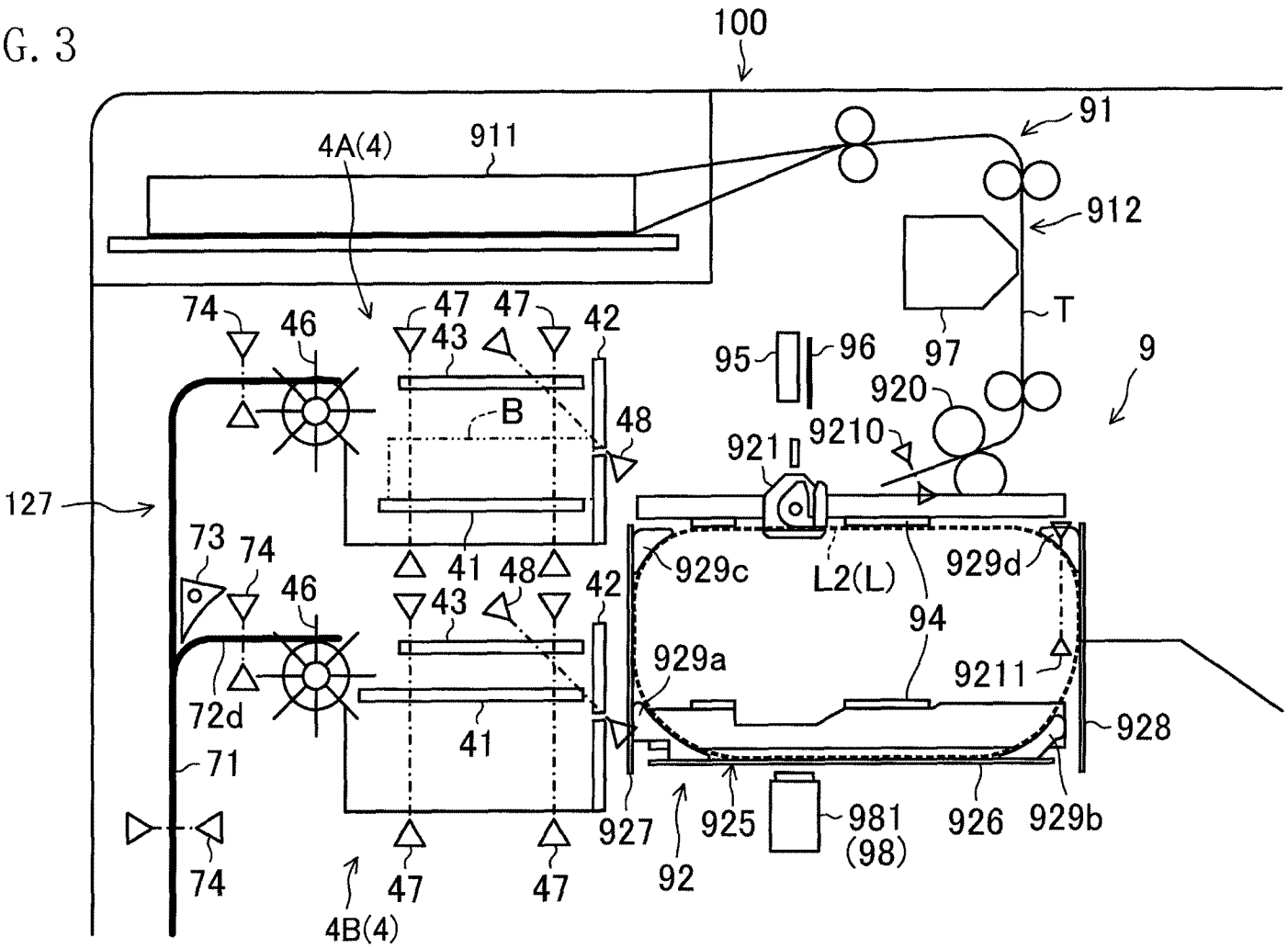
FIG. 3 illustrates a general configuration for bundling stackers and a bundling unit.

FIG. 3 illustrates a general configuration for the bundling stackers 4 and the bundling unit 9.

The bundling stackers 4 pile and stack the banknotes B that have been transported through the first transport unit 7. The banknotes B are transported in the direction parallel to their shorter edges with one of their longer sides facing front before entering the bundling stackers 4. As shown in FIG. 3, each of the bundling stackers 4 includes a stage 41 which carries the banknotes B thereon, a guide 42 which aligns the respective longer sides of the banknotes B at the frontend in their transport direction, a top plate 43 which defines a ceiling of the bundling stacker 4, a door 44 (see FIG. 1) which opens/closes the first outlet 49 to be described later, an alignment mechanism 45 (see FIG. 7) which aligns the respective edges of the banknotes stacked, a stacking wheel 46 which brings the transported banknotes B into the bundling stacker 4, a first banknote sensor 47 which detects the banknotes B in the bundling stacker 4, and a second banknote sensor 48 which detects the banknotes B of a predetermined height in the bundling stacker 4. Detailed configurations of the stage 41, guide 42, door 44, and alignment mechanism 45 will be described later.

The stacking wheel 46 includes a plurality of flexible blades, and has the function of tapping the banknotes B transported into the bundling stacker 4 on their rear edges in the transport direction so as to help the banknotes B fall. Even when the banknotes B are brought into the bundling stacker 4 successively, each of the banknotes B is prevented from being inserted below the rear edge of the preceding banknote B, and thus the banknotes B can be sequentially stacked one by one on top of the previously stacked ones.

Two or more first banknote sensors 47 are provided for each of the bundling stackers 4. In the present embodiment, two first banknote sensors 47, 47 are provided in the bundling stacker 4 at different positions in the transport direction of the banknotes B. The first banknote sensor 47 is configured in the same manner as the banknote sensor 25. Each of the first banknote sensors 47 is arranged to project light in the stacking direction of the banknotes B in the bundling stacker 4. That is to say, the first banknote sensor 47 can detect the presence of the banknotes B in the bundling stacker 4 when the light is blocked. The provision of the two first banknote sensors 47, 47 at the different positions in the transport direction enables any one of the first banknote sensors 47, 47 to detect the presence of the banknotes B even when the positions of the banknotes B vary in the transport direction in the bundling stacker 4. Note that two or more first banknote sensors 47 may be provided at different positions in the direction orthogonal to both of the transport and thickness directions of the banknotes B (the direction coming out of the paper of FIG. 2).

The second banknote sensor 48 is configured to detect the banknotes B located at a predetermined height in the bundling stacker 4. The second banknote sensor 48 is configured in the same manner as the banknote sensor 25. The second banknote sensor 48 is arranged such that light emitted from the transmitter to the receiver is blocked by the banknotes B when the banknotes B are present at a level higher than the predetermined height, and that the light emitted from the transmitter reaches the receiver when the banknotes B are not present at the level higher than the predetermined height.

<Configuration for Non-Bundling Stacker 5>

The non-bundling stackers 5 pile and stack the banknotes. As shown in FIG. 2, each of the non-bundling stackers 5 includes a container 50 in which the banknotes are stacked, a stacking wheel 51 which brings the transported banknotes into the container 50, and a stacking sensor 52 which detects the presence of the banknotes.

The container 50 of each of the non-bundling stackers 5 has a tilted bottom. Thus, the banknotes brought into the container 50 are collected to the lower end of the bottom.

The stacking sensor 52 is provided at the lower end of the bottom of the container 50. The stacking sensor 52 is configured in the same manner as the banknote sensor 25, and detects the banknotes in the container 50 when the light is blocked. The stacking sensor 52 is arranged such that the light is blocked by the banknotes in the container 50.

The stacking wheel 51 includes a plurality of blades, and catches the transported banknotes between the blades to bring them into the container 50. The banknotes are released from the blades of the stacking wheel 51 near the bottom of the container 50, and are stacked in the container 50.

The container 50 has openings through the second side surface 124 of the housing 12 as shown in FIG. 1. That is to say, the second side surface 124 is provided with second outlets 53 through which the banknotes stacked in the non-bundling stackers 5 are removed out of the housing 12. The second outlets 53 have no door, and are kept opened. The second outlets 53 of the first and second non-bundling stackers 5A and 5B are opened through the second side surface 124 and are arranged side by side in the horizontal direction.

Each of the non-bundling stackers 5 is provided with a pushing mechanism 54 which pushes the stacked banknotes toward the second outlet 53. The pushing mechanism 54 is provided at the horizontal depth of the container 50 (opposite from the second outlet 53), and is configured to push the banknotes from the horizontal depth to the front (toward the second outlet 53).

<Configuration for Reject Stacker 6>

The reject stacker 6 piles and stacks the banknotes. The reject stacker 6 includes, as shown in FIG. 2, a container 60 in which the banknotes are stacked, a stacking wheel 61 which brings the transported banknotes into the container 60, a stacking sensor 62 which detects the presence of the banknotes, and stoppers 64, 64 which prevent the banknotes in the container 60 from being ejected outside.

Specifically, the container 60 of the reject stacker 6 has an opening through the first side surface 123 of the housing 12 as shown in FIG. 1. That is, a reject outlet 63 through which the banknotes stacked in the reject stacker 6 are removed out of the housing 12 is provided through the first side surface 123. The reject outlet 63 is opened through the first side surface 123 to be positioned above the inlet 24. The reject outlet 63 has no door and is kept opened.

The bottom of the container 60 is tilted such that the more distant from the first side surface 123, the lower the level of the bottom. Thus, the banknotes in the container 60 are stacked deep inside the first side surface 123. In this manner, the banknotes are prevented from being ejected outside through the reject outlet 63 of the first side surface 123 when they are brought into the container 60.

The two stoppers 64, 64 are provided at one edge of the bottom of the container 60 closer to the first side surface 123. The stoppers 64 are supported to be rotatable around an axis extending parallel to the edge of the bottom closer to the first side surface 123, and are biased by bias springs (not shown) to stand up on the bottom of the container 60. These stoppers 64, 64 can also prevent the banknotes in the container 60 from being ejected outside through the reject outlet 63 of the first side surface 123. Note that the banknotes stacked in the reject stacker 6 may be removed through the reject outlet 63 with the stoppers 64, 64 pressed down against the elastic force of the bias springs.

The stacking wheel 61 includes a plurality of flexible blades, and has the function of tapping the banknotes falling into the container 60 on their rear edges in the transport direction so as to help the banknotes fall. Even when the banknotes are brought into the container 60 successively, each of the banknotes is prevented from being inserted below the rear edge of the preceding banknote, and thus the banknotes can be sequentially stacked one by one on top of the previously stacked ones.

The stacking sensor 62 is configured in the same manner as the banknote sensor 25, and detects the banknotes in the container 60 when the light is blocked. The stacking sensor 62 is arranged such that the light is blocked by the banknotes in the container 60.

<Configuration of Bundling Unit 9>

As shown in FIG. 3, the bundling unit 9 includes a tape feeding unit 91 which feeds a tape T, a tape loop forming unit 92 which forms a tape loop L from the tape T, a clamp 94 which presses the banknotes B in the stacking direction when the banknotes B are bundled together with the tape T, a heater 95 which heat-seals portions of the tape T wound around the banknotes B, a cutter 96 which cuts the tape T at a portion not wound around the banknotes B, a printer 97 which prints characters on the tape T, and a stamper 98 which stamps a seal on the tape T.

The tape feeding unit 91 includes a tape reel 911 around which the tape T is wound, and a tape transport unit 912 which transports the tape T drawn from the tape reel 911. The tape transport unit 912 transports the tape T along a predetermined transport path. The tape transport unit 912 has a guide (not shown) and multiple pairs of rollers.

The tape loop forming unit 92 forms a tape loop L from the tape T, and rewinds the tape T after the stacked banknotes B are arranged in the tape loop L to wind the tape T around the banknotes B. The tape loop forming unit 92 includes a pair of feed rollers 920 which feeds and rewinds the tape T, a tape gripping part 921 which grips an end portion of the tape T, a guide 925 which defines the shape of the tape loop L being formed from the tape T, a first tape sensor 9210 which detects the end portion of the tape T, and a second tape sensor 9211 which detects that a large tape loop L2 has been formed. Although not illustrated in detail, the tape loop forming unit 92 has a small tape loop formed from the tape T by the tape gripping part 921, and then has the tape T fed by the pair of feed rollers 920 to enlarge the small tape loop into a large tape loop L2. In the meantime, the guide 925 guides the tape T to define the shape of the large tape loop L2, and the second tape sensor 9211 detects that the large tape loop L2 has been formed.

The pair of feed rollers 920 is driven by a tape feed motor 9212 (see FIG. 4), and feeds the tape T in forming the tape loop L. The pair of feed rollers 920 is located at the downstream end of the tape transport unit 912, and forms part of the tape transport unit 912. The pair of feed rollers 920 is an exemplary feeder. A pair of rollers of the tape transport unit 912 is also driven by the tape feed motor 9212 through a belt, a gear, or any other suitable mechanism.

The tape reel 911 is further provided with a tape reel motor 9111 (see FIG. 4) which rotates the tape reel 911 in the direction in which the tape T is rewound. When the tape T is going to be wound around the banknotes B that have been arranged into the tape loop L, this tape reel motor 9111 and the tape feed motor 9212 rotate in such a direction as to rewind the tape T. The tape feed motor 9212 and the tape reel motor 9111 are each implemented as a stepping motor.

The first tape sensor 9210 is provided on the transport path of the tape T between the pair of feed rollers 920 and the tape gripping part 921. The first tape sensor 9210 is configured in the same manner as the banknote sensor 25. The first tape sensor 9210 detects the tape T when the light is blocked. For example, the first tape sensor 9210 may detect the end portion of the tape T when the light that has been blocked starts being received again by the first tape sensor 9210 as the pair of feed rollers 920 rewinds the tape T.

The tape gripping part 921 is arranged at a position where the tape gripping part 921 can receive the tape T fed from the pair of feed rollers 920. Although not shown in detail, the tape gripping part 921 rotates while gripping, at the end portion thereof, the tape T fed from the pair of feed rollers 920, thereby forming the tape loop L.

While the large tape loop L2 is being formed, the guide 925 comes into contact with an outer peripheral surface of the large tape loop L2 to define the shape of the large tape loop L2. The guide 925 defines the shape of the large tape loop L2 to be a generally rectangular shape, more specifically, a rectangular shape having rounded corners.

The guide 925 includes a lower guide 926 which comes into contact with the outer peripheral surface of the large tape loop L2 from under the large tape loop L2, first and second lateral guides 927 and 928 which come into contact with the outer peripheral surface of the large tape loop L2 horizontally, and four corner guides, namely, first to fourth corner guides 929*a* to 929*d*, which respectively correspond to the four corners of the rectangle.

The lower guide 926 is provided with a displacement mechanism, and is configured to be readily moved in the vertical direction by the displacement mechanism. The displacement mechanism also functions as a displacement mechanism for lower clamps which will be described later.

The first lateral guide 927 extends in the vertical direction at one of longitudinal ends of the lower guide 926 closer to the bundling stacker 4, and regulates the position of the tape T in the tape width direction.

The second lateral guide 928 extends in the vertical direction at the other longitudinal end of the lower guide 926 closer to the dispense unit 11. The second lateral guide 928 is supported to be movable up and down by the support, and is coupled to the lower guide 926 through the link Thus, the second lateral guide 928 moves upward or downward as the lower guide 926 moves upward or downward. Note that the magnitude of movement of the second lateral guide 928 is amplified by the link. The second lateral guide 928 is configured to retreat upward during the transportation of the bundled banknotes B so as not to interfere with the transportation of the bundled banknotes B.

The second tape sensor 9211 is configured in the same manner as the banknote sensor 25, and detects the tape T when the light is blocked. The receiver of the second tape sensor 9211 is attached to the fourth corner guide 929*d* as shown schematically in FIG. 3. The transmitter of the second tape sensor 9211 is arranged such that the light emitted from the transmitter is blocked by the tape T guided along the fourth corner guide 929*d*. That is, the second tape sensor 9211 detects that the fourth corner guide 929*d* is guiding the tape T, i.e., the tape loop L has reached a predetermined size, when the light emitted from the transmitter is not received by the receiver.

The clamp 94 presses the banknotes B in the stacking direction when the banknotes B are bundled together with the tape T. The clamp 94 presses the banknotes B around their portion to be bundled with the tape T. The clamp 94 includes a pair of upper clamps provided above the banknotes B transported into the tape loop L, a pair of lower clamps provided below the banknotes B, and a displacement mechanism which allows the lower clamps to move up and down.

The lower clamps are configured to be movable up and down. In this embodiment, the lower clamps are attached to the lower guide 926 of the guide 925, and move up and down together with the lower guide 926. In other words, the displacement mechanism which displaces the lower clamps in the vertical direction also functions as the displacement mechanism for the lower guide 926.

The heater 95 bonds together portions of the tape T wound around the banknotes B. The heater 95 heat-seals such portions of the tape T. The heater 95 is an exemplary bonding unit.

The cutter 96 cuts a portion of the tape T not wound around the banknotes B, that is, an excessive portion of the tape T that has not been used to bundle the banknotes B together with the tape T. The cutter 96 has a saw-toothed cutting edge at its end. The cutter 96 is an exemplary cutting unit.

The heater 95 and the cutter 96 are configured as a unit, and is arranged opposite to the stamper 98 relative to the banknotes B brought into the tape loop L, that is, opposite to the stamper 98 in the stacking direction of the banknotes B. More specifically, the heater 95 and the cutter 96 are arranged above the tape gripping part 921. The heater 95 bonds those portions of the tape T on the tape gripping part 921. The cutter 96 cuts the tape T on the tape gripping part 921.

The printer 97 is arranged in the tape transport unit 912 as shown in FIG. 3. The printer 97 includes a print head which prints characters on the tape T transported by the tape transport unit 912. The printer 97 prints, for example, information about the banknotes B to be bundled (e.g., denomination, date, and/or serial number) on the tape T. The print made by the printer 97 is shifted in the tape width direction from a portion on which a seal will be stamped by the stamper 98 so that the print does not overlap with the seal stamped by the stamper 98.

The stamper 98 stamps a seal on the tape T wound around the banknotes B compressed by the clamp 94. The stamper 98 stamps a seal related to the banknotes B to be bundled (e.g., a seal of a financial institution, a seal indicating the kind of the banknotes such as fit or unfit notes) on the tape T. The stamper 98 is arranged opposite to the heater 95 and the cutter 96 relative to the banknotes B brought into the tape loop L, in particular, opposite to the heater 95 and the cutter 96 in the stacking direction of the banknotes B. The stamper 98 includes a stamp 981 and a displacement mechanism (not shown) which displaces the stamp 981 in the vertical direction. When the displacement mechanism displaces the stamp 981 upward, the stamp 981 stamps a seal on the tape T wound around the banknotes B in the stacking direction of the banknotes B. The stamper 98 forms an integral part of the lower guide 926, and moves up and down along with the lower guide 926 that is moving up and down.

<System Configuration for Banknote Handling Apparatus>

Figure 4:
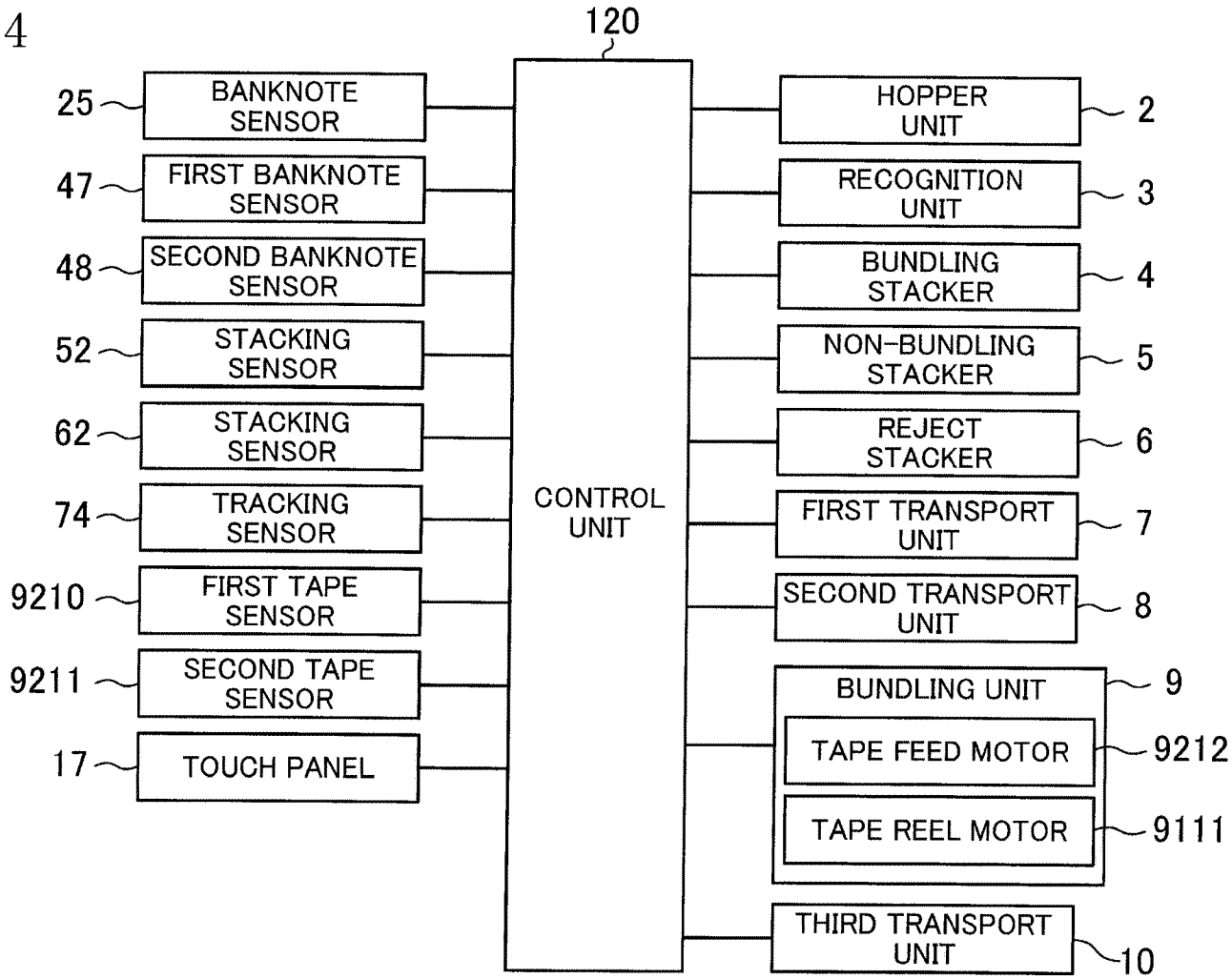
FIG. 4 is a block diagram illustrating a general configuration for the banknote handling apparatus.

FIG. 4 is a block diagram illustrating a general configuration for the banknote handling apparatus 100.

The banknote handling apparatus 100 includes a control unit 120 based on a well-known processor, for example. The control unit 120 is connected to the above-described units, namely, the hopper unit 2, the recognition unit 3, the bundling stackers 4, the non-bundling stackers 5, the reject stacker 6, the first and second transport units 7 and 8, the bundling unit 9, the third transport unit 10, and the touch panel 17 so as to transmit and receive signals to/from these units. The control unit 120 is also connected to the banknote sensor 25, the first and second banknote sensors 47 and 48, the stacking sensors 52 and 62, the tracking sensors 74, and the first and second tape sensors 9210 and 9211 to receive detection signals from these sensors. The control unit 120 generates a control signal based on the signal supplied from the touch panel 17, the detection signals from the sensors and other suitable signals, and outputs the generated control signal to the hopper unit 2 and other units. The hopper unit 2 and other units operate in accordance with the control signal. Taking the bundling stacker 4 as an example, the control unit 120 controls the stage 41, the guide 42, the locking mechanism 44*c*, the alignment mechanism 45, and the stacking wheel 46.

<Working Mechanism of Banknote Handling Apparatus>

It will be described how to perform deposit processing using this banknote handling apparatus 100. In the deposit processing, loose banknotes are sorted and stacked in the predetermined stackers, and predetermined ones of them are bundled. In the following description, single-kind banknote bundling processing will be described, in which a predetermined number of banknotes of a prescribed kind to be bundled are stacked alternately in the first and second bundling stackers 4A, 4B, and the predetermined number of banknotes stacked are bundled sequentially by the bundling unit 9.

The banknote handling apparatus 100 is placed on a teller counter to be positioned on the front left side of the operator (on the front right side of a customer) when the operator faces the customer over the teller counter. At this time, the banknote handling apparatus 100 is arranged such that the first side surface 123 of the housing 12 faces the customer. In this state, the second side surface 124 of the housing 12 faces the operator. However, since the banknote handling apparatus 100 is located slightly on the front left side of the operator, the customer can also see the second side surface 124.

First, the operator receives loose banknotes to be deposited from the customer, and places the banknotes on the hopper unit 2. At this time, even if the loose banknotes include banknotes of multiple different kinds, all the banknotes are just placed on the hopper unit 2 without being sorted. The operator adjusts the guides 22 according to the dimensions of the banknotes. Then, the operator operates the touch panel 17 to start the intake of the banknotes. The banknote handling apparatus 100 may automatically start the intake of the banknotes when the banknote sensor 25 detects the banknotes placed on the hopper unit 2.

The banknotes placed on the hopper unit 2 are brought into the housing 12 one by one through the inlet 24 as the intake rollers 23 are activated. The banknotes thus taken in are transported by the first transport unit 7, and pass through the recognition unit 3. The recognition unit 3 detects the kind of the banknotes passed, and informs the control unit 120 of the kind of the banknotes.

The control unit 120 designates the banknotes' destination according to the kind of the banknotes. In particular, if the banknotes are fit banknotes of a predetermined denomination to be bundled, the control unit 120 designates the bundling stacker 4 (any one of the bundling stackers 4A and 4B) as their destination. If the banknotes are unfit banknotes of the predetermined denomination to be bundled, the control unit 120 designates the first non-bundling stacker 5A as their destination. If the banknotes are of any denomination other than the predetermined denomination, the control unit 120 designates the second non-bundling stacker 5B as their destination. If the banknotes are rejected banknotes, the control unit 120 designates the reject stacker 6 as their destination.

The control unit 120 controls the first transport unit 7 such that the banknotes are transported to the stacker designated as their destination. In particular, the control unit 120 controls the sorting mechanism 73 corresponding to the diverged path 72 leading to the destination stacker such that the banknotes are guided from the main transport path 71 to the diverged path 72. The control unit 120 switches the sorting mechanism 73 when the tracking sensor 74 just before the diverged path 72 detects the banknotes. Further, the control unit 120 controls the stacking wheel 46, 51, or 61 of the destination stacker to bring the banknotes into that stacker.

The banknotes to be transported to the bundling stacker 4 are transported to one of the two bundling stackers 4. When the number of banknotes stacked in one of the bundling stackers 4 reaches a predetermined bundling number (e.g., 100), the remaining banknotes are then transported to the other bundling stacker 4. In this example, the banknotes are supposed to be transported to the first bundling stacker 4A first. When the banknotes are transported one after another to the first bundling stacker 4A, the stacking wheel 46 rotates to stack the banknotes one by one. When the number of banknotes stacked in the first bundling stacker 4A reaches the bundling number, the control unit 120 controls the second transport unit 8 so that the banknotes in the first bundling stacker 4A are gripped by the gripper 81 and transported to the bundling unit 9. Then, the control unit 120 controls the bundling unit 9 so that the banknotes are bundled with the tape T.

When the number of banknotes stacked in the first bundling stacker 4A reaches the bundling number, the remaining banknotes are stacked in the second bundling stacker 4B. Then, when the number of banknotes stacked in the second bundling stacker 4B reaches the bundling number, the remaining banknotes are stacked again in the first bundling stacker 4A. By this time, the banknotes in the first bundling stacker 4A have been all bundled together, and thus the first bundling stacker 4A is now empty. Thus, the provision of the two bundling stackers 4 makes it possible to perform the bundling processing while stacking the banknotes continuously.

Subsequently, the control unit 120 controls the third transport unit 10 so that the bundled banknotes are dispensed through the dispense port 111.

The unfit banknotes of the predetermined denomination are transported to the first non-bundling stacker 5A. When the banknotes are transported to the first non-bundling stacker 5A, the stacking wheel 51 rotates to stack the transported banknotes in the container 50. Thus, the unfit banknotes of the predetermined denomination are stacked in the first non-bundling stacker 5A. Likewise, the banknotes of any denominations other than the predetermined denomination are transported to, and stacked in, the second non-bundling stacker 5B. The rejected banknotes are also transported to, and stacked in, the reject stacker 6.

This series of processing steps will be performed over and over again until there are no banknotes placed on the hopper unit 2. The banknote sensor 25 determines whether banknotes are still present on the hopper unit 2 or not.

When the handling of the banknotes placed on the hopper unit 2 is finished, the rejected banknotes are taken in and recognized again. Specifically, the operator extracts the rejected banknotes from the reject stacker 6, and places them on the hopper unit 2 to take them into the apparatus again. The rejected banknotes are those which were not recognized as normal banknotes for any reason, and thus another attempt is made to take in and recognize them. Banknotes still recognized as rejected banknotes, if any, are restacked in the reject stacker 6. Then, the operator returns those restacked banknotes to the customer.

Note that the banknotes stacked in the first and second non-bundling stackers 5A, 5B are not taken in again.

Thus, when the handling of the banknotes placed on the hopper unit 2 and the re-handling of the rejected banknotes are finished, the single-kind banknote bundling processing is finished, i.e., the counting and sorting of the banknotes passed as those to be deposited by the customer are finished. The touch panel 17 displays the counted amount of the banknotes. The operator asks for the customer's approval of the amount, or checks whether the displayed amount corresponds with the amount written down on a deposit slip by the customer, and, if the answer is YES, the operator operates the touch panel 17 to confirm the deposit amount. When the confirmation is done, a teller terminal (not shown) is informed of the confirmed deposit amount, thereby finishing the deposit processing.

After the deposit processing is finished, the operator removes the bundled banknotes dispensed by the dispense unit 11, the banknotes stacked in the bundling stackers 4, and the banknotes stacked in the non-bundling stackers 5, and stores them in a predetermined storage place.

Through this series of processing steps, loose banknotes of different kinds are sorted into fit banknotes of a predetermined denomination, unfit banknotes of the predetermined denomination, banknotes of every denomination but the predetermined denomination, and rejected banknotes. The fit banknotes of the predetermined denomination are bundled on a bundling number basis.

<Detailed Configuration of Bundling Stacker 4>

Figure 5:
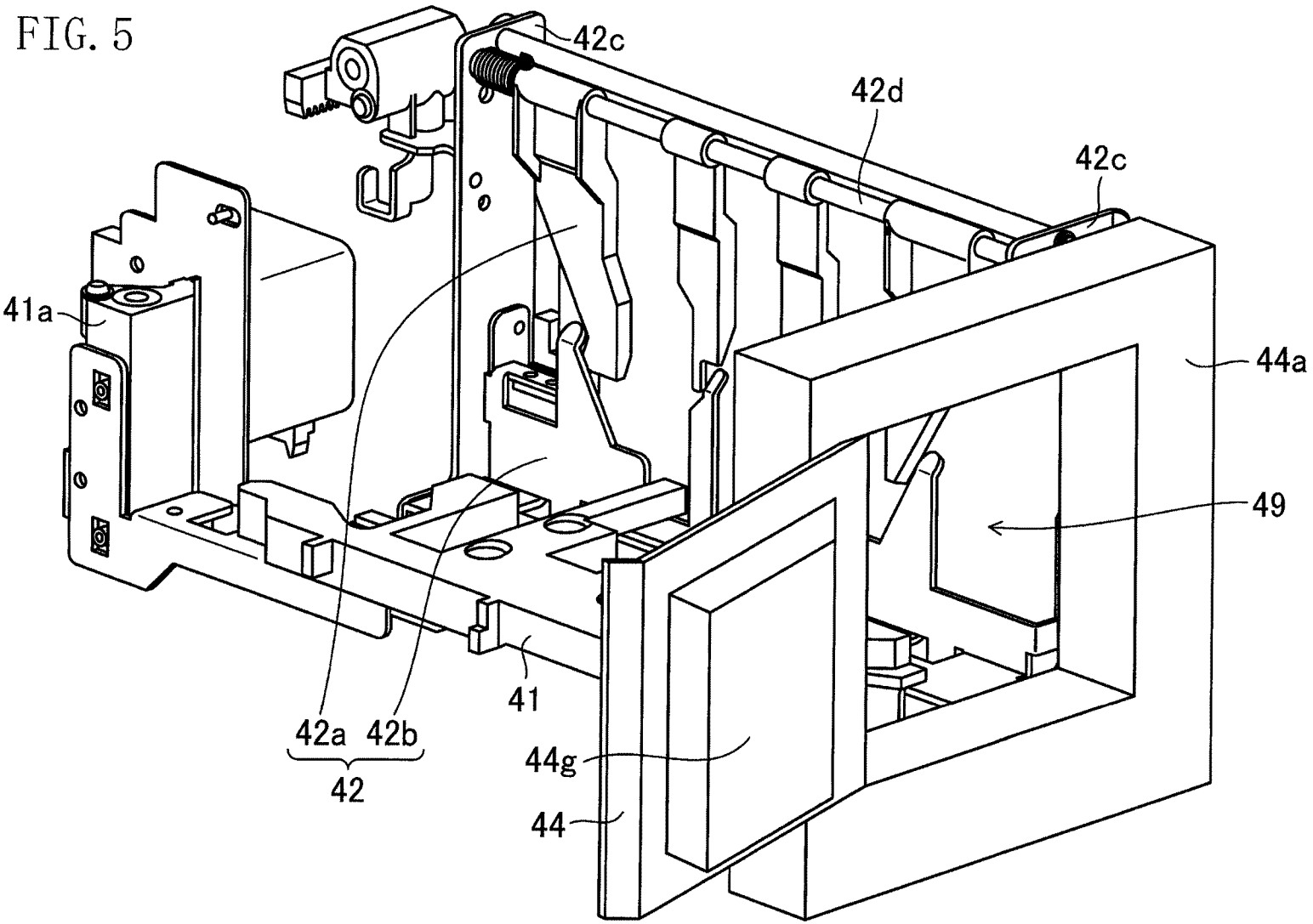
FIG. 5 is a perspective view illustrating a principal section of the bundling stackers.
Figure 6:
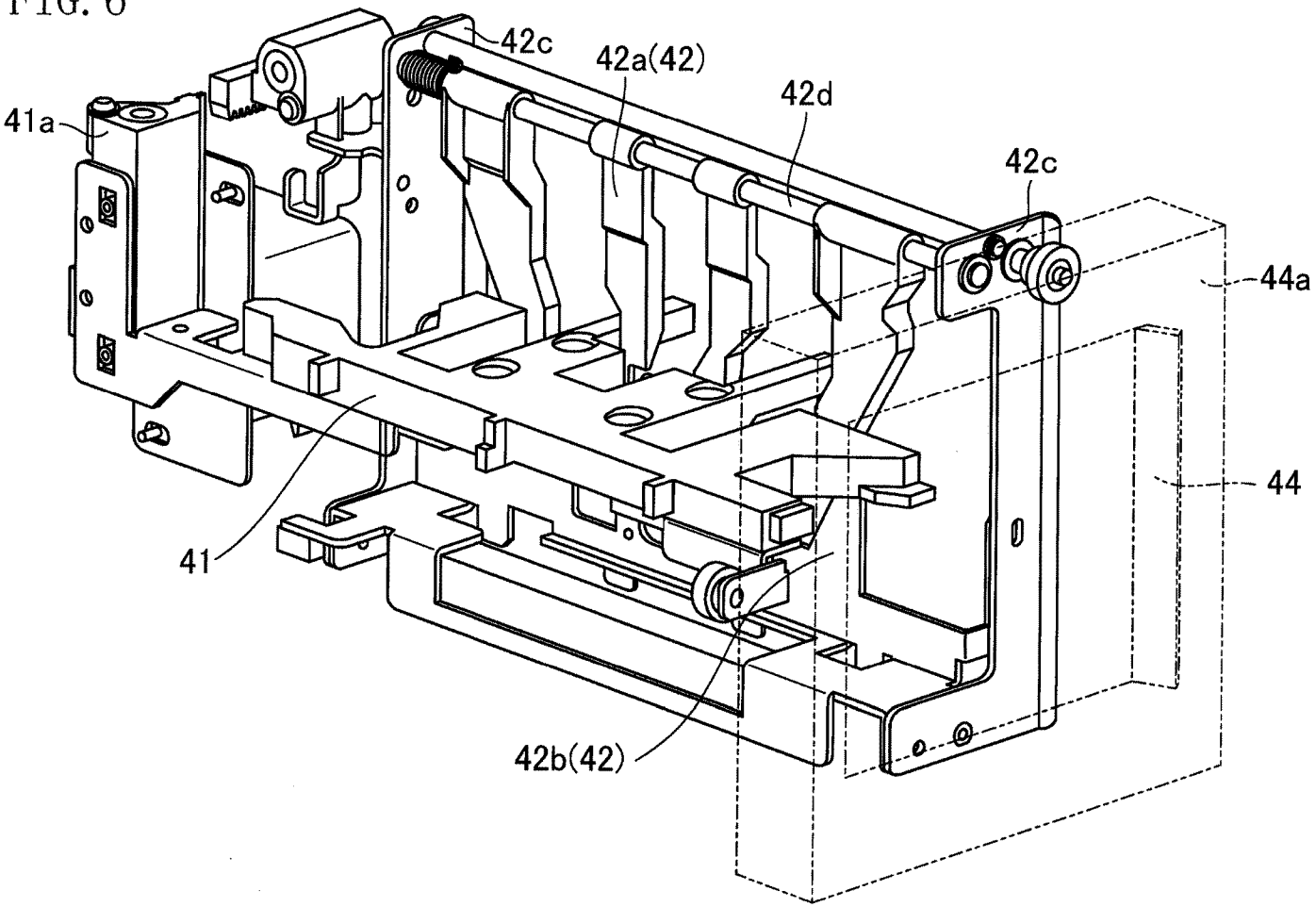
FIG. 6 is a perspective view corresponding to FIG. 5 and illustrating a state where the stage and guide of the bundling stacker have moved.
Figure 7:
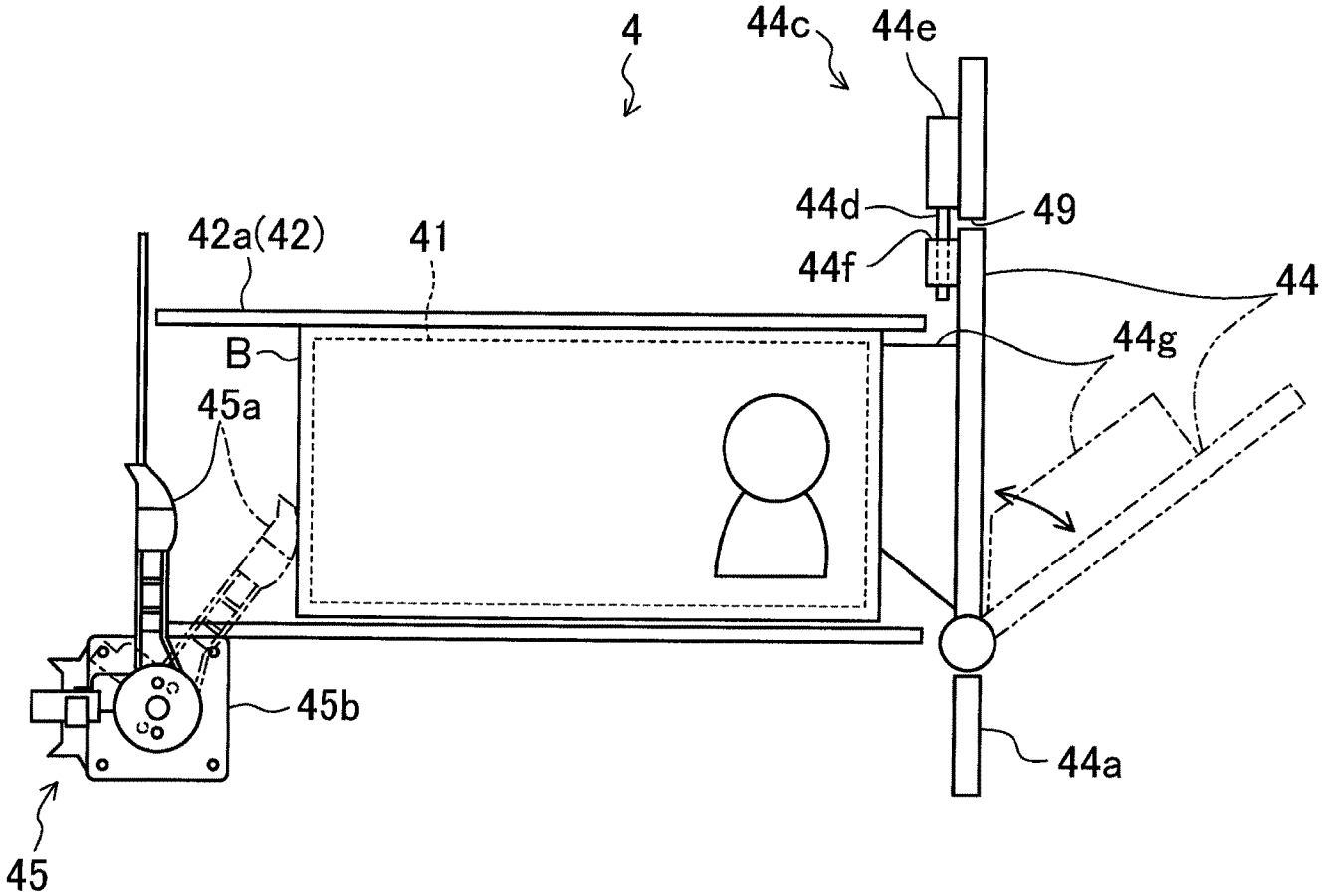
FIG. 7 is a plan view illustrating generally the bundling stacker with a portion thereof omitted.

FIG. 5 is a perspective view illustrating a principal section of the bundling stacker 4. FIG. 6 is a perspective view corresponding to FIG. 5 and illustrating a state where the stage 41 and guide 42 of the bundling stacker 4 have moved. FIG. 7 is a plan view illustrating generally the bundling stacker 4 with a portion thereof omitted. In FIG. 6, the door 44 and the frame 44*a* are indicated by phantom lines.

The stage 41 is configured to be movable up and down. Specifically, the stage 41 is coupled to a vertical mover 41*a*, which is secured to a vertically extending shaft (not shown) so as to be movable up and down, and which is driven vertically by a motor (not shown). The stage 41 has a comb-tooth shape.

The guide 42 is configured to be movable in the transport direction of the banknotes B. Specifically, the guide 42 is comprised of an upper guide 42*a* and a lower guide 42*b*. The upper guide 42*a* is mounted to a rotatable shaft 42*a* provided for a pair of frames 42*c*, 42*c* which moves in the transport direction of the banknotes B. The pair of frames 42*c*, 42*c* is movably mounted to a horizontal shaft (not shown) extending in the transport direction, and is driven by a motor (not shown) along the horizontal shaft. The rotatable shaft 42*d* is supported rotatably by the pair of frames 42*c*, 42*c*. The rotatable shaft 42*d* is driven in rotation by the motor (not shown). The upper guide 42*a* rotates along with the rotatable shaft 42*d*. On the other hand, the lower guide 42*b* is fixed on the pair of frames 42*c*, 42*c*. The lower guide 42*b* is provided under the upper guide 42*a*. The upper guide 42*a* is formed to have a shape with four comb teeth. Likewise, the lower guide 42*b* is also formed to have such a shape with four comb teeth.

With the upper guide 42*a* hanging down from the rotatable shaft 42*d*, the upper guide 42*a* and the lower guide 42*b* form a wall at the frontend of the transport direction for the bundling stacker 4. In this case, the respective comb teeth of the upper and lower guides 42*a* and 42*b* define three slits extending vertically. Two outer ones of these three slits are arranged at such positions as to allow two comb teeth of the stage 41 to enter the slits. As described above, as the frames 42*c*, 42*c* move, the upper and lower guides 42*a* and 42*b* move back and forth in the transport direction of the banknotes B. In the meantime, the comb teeth of the stage 41 enter the slits formed by the respective comb teeth of the upper and lower guides 42*a* and 42*b*, thereby substantially preventing the stage 41 from interfering with the upper and lower guides 42*a* and 42*b*. In addition, since the slits extend vertically, the interference between the comb teeth of the stage 41 and the upper and lower guides 42*a* and 42*b* is also avoidable even if the stage 41 moves vertically.

Meanwhile, as the rotatable shaft 42*d* rotates, the upper guide 42*a* turns so as to open forward in the transport direction, thereby opening the bundling stacker 4 forward in the transport direction.

At one end of the bundling stacker 4 in the direction perpendicular to both the transport direction and stacking direction of the banknotes B (such a direction will be hereinafter referred to as a "width direction"), provided is a generally square frame 44*a*, which has a first outlet 49 in a generally square shape.

The door 44 is attached so as to be pivotable freely on a shaft provided on one side of the frame 44*a*. The door 44 rotates to change between an open state where the first outlet 49 is open and a closed state where the first outlet 49 is closed. The door 44 is biased to such a direction as to have the open state by a coil spring (not shown) provided for the shaft. The door 44 is made of a material which allows visual check of the inside of the bundling stacker from outside. For example, the door 44 may be made of a transparent or translucent material (e.g., glass or a resin). The first outlet 49 is an exemplary outlet.

The door 44 is also provided with a locking mechanism 44*c* as shown in FIG. 7. The locking mechanism 44*c* is configured to be switchable between a locked state in which the door 44 is locked to the closed state and an unlocked state in which the door 44 is allowed to open and close freely. Specifically, the locking mechanism 44*c* includes a pin 44*d* provided for the frame 44*a*, a drive mechanism 44*e* including a solenoid for driving the pin 44*d*, and an engaging portion 44*f* provided for the door 44 and engaging with the pin 44*d*. The locking mechanism 44*c* is controlled by the control unit 120 individually on a bundling stacker (4) basis. That is to say, its door 44 is openable and closable individually.

The locking mechanism 44*c* switches to such a state of unlocking the door 44 at least while the transportation of the banknotes by the first, second and third transport units 7, 8, and 10, stacking the banknotes in the bundling stackers 4, or bundling of the banknotes by the bundling unit 9 is not affected. In other words, the locking mechanism 44*c* is in the locked state at least while the transportation, stacking or bundling of the banknotes is affected. Unless the transportation, stacking, or bundling of the banknotes is affected, the locking mechanism 44*c* may be switched from the locked state to the unlocked state. It should be noted, however, that the locking mechanism 44*c* is not automatically unlocked whenever the transportation, stacking, or bundling of the banknotes is not affected. Depending on the control performed by the control unit 120, the locking mechanism 44*c* may be in the locked state, even while the transportation, stacking, or bundling of the banknotes is not affected.

Inside the door 44, provided is a stopper 44*g* (not shown in FIG. 1) with which one of the shorter edges of the banknotes B contacts. The stopper 44*g* is made of a material which allows visual check of the inside of the bundling stacker from outside. For example, the stopper 44*g* may be made of a transparent or translucent material (e.g., glass or a resin).

An alignment mechanism 45 is provided at the other end of the bundling stacker 4 opposite from the door 44. That is to say, the alignment mechanism 45 is provided so as to face the other shorter edge of the banknotes B in the bundling stacker 4 opposite from the door 44. The alignment mechanism 45 aligns the respective edges of the banknotes in the width direction with each other. In this embodiment, as the banknotes are transported in the direction parallel to the shorter edges of the banknotes, the width direction corresponds to the direction parallel to the longer edges of the banknotes. In other words, the alignment mechanism 45 aligns the respective shorter edges of the banknotes. The alignment mechanism 45 includes an arm 45*a* which is provided to be rotatable on a shaft extending in the stacking direction of the banknotes B and a stepping motor 45*b* which rotates the arm 45*a*. By pressing one shorter edge of the banknotes B toward the door 44 with the arm 45*a*, the alignment mechanism 45 brings the other shorter edge of the banknotes into contact with the stopper 44*g*. That is to say, the alignment mechanism 45 aligns the respective shorter edges of the banknotes B in cooperation with the door 44. In this manner, the banknotes in the bundling stacker 4 are aligned with each other in contact with the stopper 44*g*.

Figure 8:
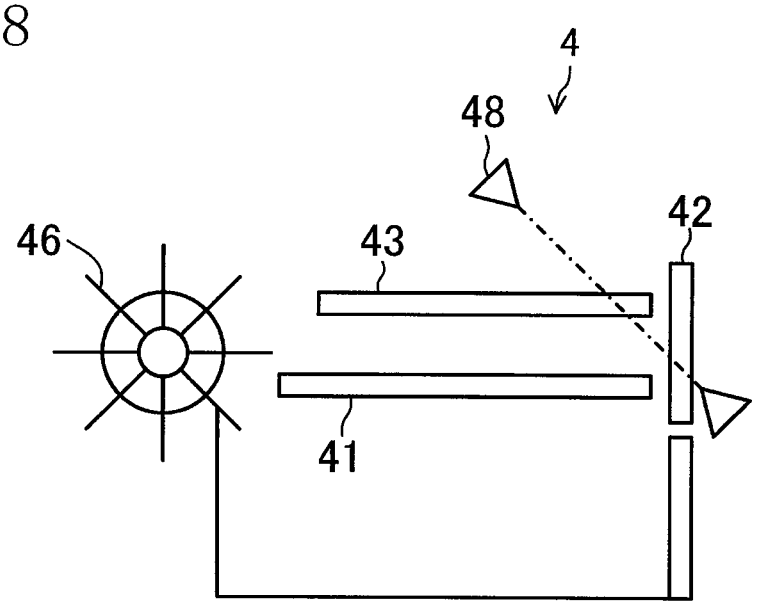
FIG. 8 illustrates how each of the bundling stackers operates when stacking processing is started.
Figure 9:
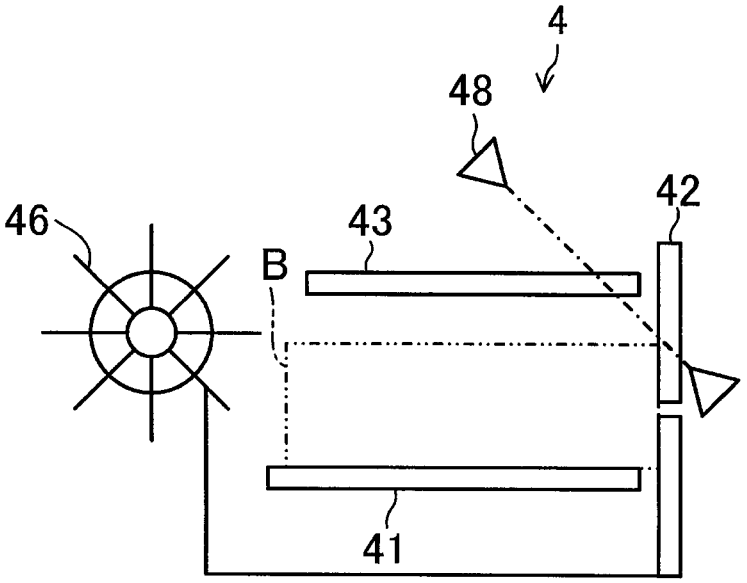
FIG. 9 illustrates how the bundling stacker operates during stacking.
Figure 10:
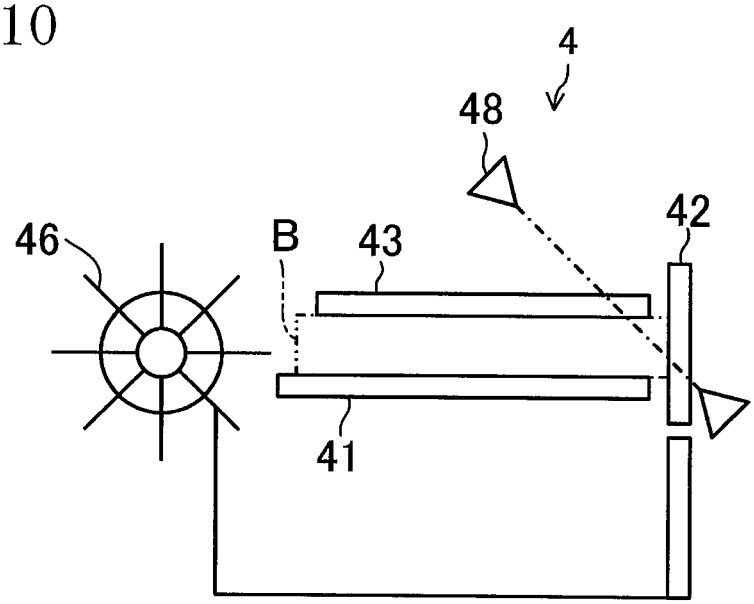
FIG. 10 illustrates how the bundling stackers operate during compression.
Figure 11:
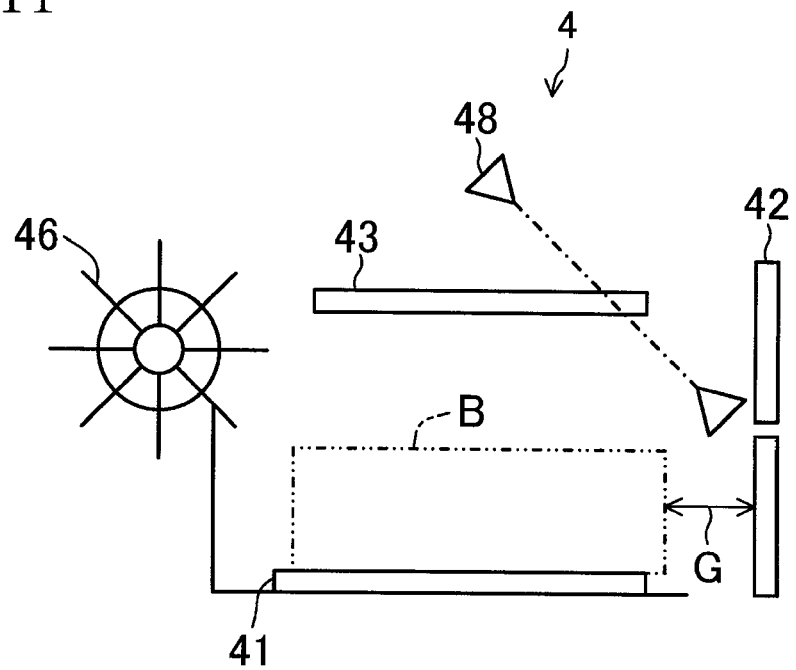
FIG. 11 illustrates how the bundling stackers operate during removal.

Next, it will be described how the control unit 120 controls the bundling stackers 4. FIG. 8 schematically illustrates how each of the bundling stackers 4 operates when the stacking is started. FIG. 9 schematically illustrates how the bundling stacker 4 operates during stacking. FIG. 10 schematically illustrates how the bundling stacker 4 operates during compression. FIG. 11 schematically illustrates how the bundling stacker 4 operates during removal.

First of all, before the banknotes B transported enter the bundling stacker 4, the control unit 120 moves the stage 41 to its initial position and also moves the guide 42 to a position associated with the kind of the banknotes B as shown in FIG. 8. The initial position of the stage 41 is set at a relatively high level and close to the stacking wheel 46. This thus allows the banknotes B falling into this bundling stacker 4 to go a relatively short distance and to settle with stability.

In addition, the control unit 120 moves the guide 42 to an appropriate position according to the kind of the banknotes B transported to the bundling stacker 4. Since the banknotes B are transported such that the direction parallel to their shorter edges corresponds with the transport direction, the position of the guide 42 is adjusted according to the dimension of the banknotes B as measured in the direction parallel to their shorter edges. Specifically, the guide 42 is arranged at such a position that makes the banknotes B transported to the bundling stacker 4 contact with the guide 42, fall onto the stage 41 as they are, and be finally stacked in contact with the guide 42.

Even after this state is established as an initial state, more and more banknotes B are transported to, and enter, the bundling stacker 4. Since the banknotes B transported to the bundling stacker 4 have momentum in the transport direction, one of the longer edges of the banknotes B that is located on the front side in their transport direction contacts with the guide 42 to let the banknotes B fall onto the stage 41 by themselves. In this case, their fall is promoted by the stacking wheel 46. As shown in FIG. 9, the longer edge of the banknotes B on the front side in their transport direction is substantially in contact with the guide 42 on the stage 41. That is to say, the respective longer edges of the banknotes B are now aligned with each other.

Every time the number of banknotes stacked in the bundling stacker 4 reaches a predetermined number (e.g., 10), the control unit 120 lowers the stage 41 to such a degree as corresponding to the predetermined number. With this operation performed repeatedly, the stacking space on the stage 41 is gradually expanded as the number of banknotes B stacked increases. Nevertheless, the second banknote sensor 48 monitors the level of the uppermost one of the banknotes (hereinafter referred to as the "uppermost banknote") on the stage 41. When the uppermost banknote is detected by the second banknote sensor 48, the stage 41 is lowered to a predetermined degree such that the second banknote sensor 48 no longer detects any banknotes. That is to say, the control unit 120 basically performs the control of lowering the stage 41 every time the number of banknotes stacked there reaches a predetermined number. However, on detecting that the level of the uppermost banknote has exceeded the level detectable for the second banknote sensor 48, the control unit 120 lowers the stage 41 independently of the basic control. In this manner, the banknotes falling into the bundling stacker 4 are allowed to always go substantially the same distance. As a result, the banknotes falling by themselves may settle at an identical position and at a constant angle.

Whenever a single banknote B is transported into the bundling stacker 4, the arm 45*a* of the alignment mechanism 45 presses one of the shorter edges of the banknote B to bring the other shorter edge of the banknote B into contact with the stopper 44*g* of the door 44. In this manner, the respective shorter edges of the banknotes B stacked may be aligned with each other.

Subsequently, as shown in FIG. 10, the control unit 120 raises the stage 41, thereby compressing the stacked banknotes B with the stage 41 and the top plate 43 to a predetermined thickness. Note that if the thickness of the banknotes B that have fallen onto the stage 41 by themselves and have been stacked there is short of the predetermined thickness (e.g., when the banknotes B are all new banknotes), the banknotes B are not compressed even when the stage 41 is raised.

Thereafter, the control unit 120 rotates the upper guide 42*a* of the guide 42 toward the front end in the transport direction, thereby opening the bundling stacker 4.

When the bundling stacker 4 is opened, the gripper 81 of the second transport unit 8 grips the banknotes B. Since the gripper 81 has such a shape that makes itself insertable into the gap between the comb teeth of the stage 41, the gripper 81 may grip the banknotes B on the stage 41 without interfering with the stage 41. Then, the second transport unit 8 transports the banknotes B from the bundling stacker 4 to the bundling unit 9. After that, the bundling processing will be performed.

Meanwhile, if the banknotes B have all been taken in while the number of banknotes B stacked in the bundling stacker 4 is still short of the predetermined bundling number, then the banknotes yet to be bundled remain in the bundling stacker 4. In that case, the control unit 120 unlocks the door 44 and prompts the operator to remove the banknotes B from the bundling stacker 4.

When the banknotes are all taken in, the banknotes should remain in only one, or neither, of the first and second bundling stackers 4A, 4B. The control unit 120 unlocks the locking mechanism 44*c* of the bundling stacker 4 with the remaining banknotes but keeps the locking mechanism 44*c* of the bundling stacker 4 with no remaining banknotes locked. The door 44, of which the locking mechanism 44*c* is unlocked, opens by itself under the biasing force of the coil spring.

At this time, the control unit 120 lowers the stage 41 as shown in FIG. 11 from its level while the banknotes B are being stacked. The control unit 120 may move the stage 41 to the lowest level, for example. In addition, the control unit 120 also moves the guide 42 from its position while the banknotes B are being stacked to the front side in the transport direction. As a result, a gap G is formed between the guide 42 and the banknotes B. The control unit 120 may move the guide 42 to a position closest to the frontend in the transport direction, for example. In this manner, a space broad enough for the operator to remove the banknotes B easily may be left over the banknotes B and on the front side in the transport direction.

The control unit 120 notifies the operator that the banknotes have all been taken in but that some banknotes B remain in the bundling stacker 4. For example, the control unit 120 may display, on the touch panel 17, a message indicating that the banknotes have all been taken in. Also, if there is any bundling stacker 4 where the banknotes remain, the control unit 120 may display, on the touch panel 17, a message indicating in which bundling stacker 4 the banknotes remain and that the locking mechanism 44*c* is unlocked. On reading the message on the touch panel 17, the operator removes the banknotes B from the bundling stacker 4 through the first outlet 49.

Note that not only when the banknotes B are all taken in but also when a banknote jam or any other error occurs, the banknotes B may be removed from the bundling stacker 4.

For example, if a banknote jam or any other error has occurred in any of the bundling stackers 4 while the deposit processing is being performed, then the control unit 120 unlocks the locking mechanism 44*c* of the bundling stacker 4 where the error has occurred. Then, the control unit 120 lowers the stage 41 from its position while the banknotes B are being stacked as described above, and moves the guide 42 from its position while the banknotes B are being stacked to the front side in the transport direction. In this manner, even if any error has occurred, the stage 41 and the guide 42 are moved, thereby facilitating the removal of the banknotes B.

In the foregoing description, single-kind bundling processing has been described. However, the banknote handling apparatus 100 performs various types of processing other than the single-kind bundling processing. For example, the banknote handling apparatus 100 also performs divisional processing in which a prescribed number of banknotes of a single predetermined kind are stacked in each of the first and second bundling stackers 4A, 4B and in which the prescribed number of banknotes B are just stacked there without being bundled.

In the divisional processing, loose banknotes B also are mounted on the hopper unit 2 as in the single-kind bundling processing. Thereafter, the banknotes B are taken in through the inlet 24, recognized by the recognition unit 3, and then transported to an appropriate stacker as in the single-kind bundling processing described above.

When the number of banknotes B stacked in any of the bundling stackers 4 reaches a predetermined number, the control unit 120 unlocks the locking mechanism 44*c* of the bundling stacker 4 and displays, on the touch panel 17, a message indicating that the number of banknotes B stacked in the bundling stacker 4 has reached the predetermined number. In response, the operator opens the door 44, and removes the banknotes B stacked in the bundling stacker 4.

Note that once the number of banknotes B stacked in one of the two bundling stackers 4 has reached the predetermined number, the control unit 120 has the rest of the banknotes B transported to the other bundling stacker 4. Thereafter, when the number of banknotes B stacked in the other bundling stacker 4 reaches the predetermined number, the control unit 120 unlocks the locking mechanism 44*c* of the other bundling stacker 4 and displays, on the touch panel 17, a message indicating that the number of banknotes B stacked in the bundling stacker 4 has reached the predetermined number, as in the processing performed on the one bundling stacker 4. In response, the operator opens the door 44, and removes the banknotes B stacked in the bundling stacker 4.

Also, if at a point in time when the number of banknotes B stacked in the other bundling stacker 4 reaches the predetermined number, there are no banknotes B in the one bundling stacker 4 and the door 44 is closed, then the control unit 120 keeps the locking mechanism 44*c* of the one bundling stacker 4 locked and has the banknotes B transported to the one bundling stacker 4. On the other hand, if at the point in time when the number of banknotes B stacked in the other bundling stacker 4 reaches the predetermined number, there are any banknotes B in the one bundling stacker 4 or the door 44 is opened, then the control unit 120 suspends the divisional processing. However, when there are no banknotes B anymore in the one bundling stacker 4 and the door 44 is closed, the control unit 120 resumes the divisional processing.

Even in this divisional processing, when the banknotes B are removed from any of the bundling stackers 4, the control unit 120 also lowers the stage 41 from its position while the banknotes B are being stacked, and also moves the guide 42 from its position while the banknotes B are being stacked toward the front end in the transport direction. In this manner, even during the divisional processing, the stage 41 and the guide 42 are also moved so as to facilitate removal of the banknotes B.

Optionally, in the divisional processing, not only the first and second bundling stackers 4A, 4B but also the non-bundling stackers 5 may be specified as the destinations where the banknotes B are to be stacked such that multiple different kinds of banknotes B are classified.

As can be seen from the foregoing description, this banknote handling apparatus 100 includes a bundling stacker 4 configured to stack banknotes B in itself. The bundling stacker 4 includes: a stage 41 configured to support the banknotes B in their thickness direction; and a guide 42 facing one side of the banknotes B and configured to regulate movement of the banknotes B in a predetermined regulation direction which is parallel to a surface of the banknotes B. The guide 42 moves such that while the banknotes B are removed from the bundling stacker 4, a gap G is formed in the regulation direction between the guide 42 and the one side of the banknotes B.

According to this configuration, a sufficient space is left between the banknotes B and the guide 42, and therefore, there is no friction between the banknotes B and the guide 42 and the banknotes B are allowed to move in the regulation direction, thus facilitating the removal of the banknotes B.

In one embodiment, the regulation direction may be one of two directions that are respectively (i) parallel to longer edges of the banknotes B and (ii) parallel to shorter edges of the banknotes B, and the bundling stacker 4 may have a first outlet 49 configured to remove the banknotes B in a removal direction that is one of the two directions that are respectively (i) parallel to the longer edges of the banknotes B and (ii) parallel to the shorter edges of the banknotes B. The removal direction is different from the regulation direction.

According to this configuration, the regulation direction is perpendicular to the removal direction of the banknotes B. For example, if the banknotes B are removed in the direction parallel to their longer edges, there is no friction between the banknotes B and the guide 42 while the banknotes B are being removed, and the banknotes B are allowed to move in the regulation direction, thus facilitating the removal of the banknotes B.

In another embodiment, the regulation direction may correspond with a transport direction in which the banknotes B are transported to the bundling stacker 4.

When transported to the bundling stacker 4, the banknotes B have some momentum in that transport direction. Thus, if a guide 42 is provided to regulate the movement of the banknotes B in the transport direction, the dispersion in the position of the banknotes B in the transport direction may be reduced in the bundling stacker 4.

In still another embodiment, the bundling stacker 4 may be provided with a door 44 configured to close the first outlet 49 while the banknotes B are being stacked and to open the first outlet 49 while the banknotes B are being removed.

In yet another embodiment, the door 44 may regulate the movement of the banknotes B in the removal direction while the banknotes B are being stacked. Specifically, the door 44 regulates the movement of the banknotes B in the removal direction with a stopper 44*g*.

According to this configuration, at least two edges of the banknotes B, namely, one longer edge and one shorter edge thereof, may be aligned by means of the guide 42 and the door 44.

In yet another embodiment, the stage 41 may be configured to adjust a stacking space for the banknotes B by moving in the thickness direction of the banknotes B. While the banknotes B are being stacked, as the banknotes B are stacked in increasing numbers, the stage 41 may move in the thickness direction of the banknotes B toward one of two sides that expands the stacking space. On the other hand, while the banknotes B are being removed, the stage 41 may move in the thickness direction of the banknotes B toward that one side that further expands the stacking space from its position while the banknotes B are being stacked.

According to this configuration, the stage 41 moves according to the number of banknotes B stacked, thereby adjusting the stacking space. On the other hand, while the banknotes B are being removed, the stage 41 moves toward that one side that further expands the stacking space from its position while the banknotes B are being stacked. That is to say, while the banknotes B are being removed, the stacking space is expanded, thus giving the operator a space to insert his or her fingers, for example, during the banknote B removal work. As a result, the work may be done with improved efficiency.

In yet another embodiment, the guide 42 may change its position in the regulation direction according to the kind of the banknotes B while the banknotes B are being stacked. Specifically, the position of the guide 42 may be adjusted according to the dimension of the banknotes B as measured in the transport direction.

Thus, the dispersion in the position of the banknotes B in the regulation direction (i.e., in the transport direction) may be reduced irrespective of the kind of the banknotes B.

In yet another embodiment, the banknote handling apparatus 100 may further include a bundling unit 9 configured to bundle the banknotes B stacked in the bundling stacker 4.

That is to say, the bundling stacker 4 is a place where the banknotes B are stacked before the banknotes B are bundled together by the bundling unit 9. According to such a configuration, if the banknotes B yet to be bundled remain in the bundling stacker 4 even when the processing of the banknotes B is completed or if any abnormality has occurred during the processing, the banknotes B may be removed from the bundling stacker 4.

<<Other Embodiments>>

Embodiments have just been described as examples of the technique disclosed in the present application. However, the present disclosure is not limited to those exemplary embodiments, but is also applicable to other embodiments which are altered or substituted, to which other features are added, or from which some features are omitted, as needed. Optionally, the components described in those embodiments may be combined to create a new embodiment. The components illustrated on the accompanying drawings and described in the detailed description include not only essential components that need to be used to overcome the problem, but also other unessential components that do not have to be used to overcome the problem but that are illustrated or mentioned there just for the sake of showing a typical example of the technique. Therefore, such unessential components should not be taken for essential ones, simply because such unessential components are illustrated in the drawings or mentioned in the detailed description.

The above-described embodiments may be modified in the following manner.

In the embodiments described above, the banknote handling apparatus 100 has been described as an example of the paper sheet processing device. However, the paper sheet processing device is not limited to the banknote handling apparatus 100. For example, recognition, sorting, and stacking of the paper sheets may be performed by a different apparatus, and the paper sheet processing device may only perform the processing of transporting loose paper sheets, stacking the paper sheets in the stacking unit, and then transporting the paper sheets stacked in the stacking unit to a different place using the transport unit. Further, in the foregoing description, banknotes are supposed to be used as exemplary paper sheets. However, the paper sheets do not have to be banknotes, and may be vouchers such as gift certificates.

The configuration of the banknote handling apparatus 100 described above is merely an example, and the present disclosure is not limited thereto. For example, the banknote handling apparatus 100 described above is provided with two bundling stackers 4, two non-bundling stackers 5, and a single reject stacker 6. However, the numbers of these stackers are just an example and not limiting. For example, one bundling stacker 4 or three or more bundling stackers 4 may be provided. One non-bundling stacker 5 or three or more non-bundling stackers 5 may be provided. Two or more reject stackers 6 may be provided. Alternatively, the non-bundling stackers 5 and the reject stacker 6 may even be omitted.

In the above-described embodiments, the inlet 24, the dispense port 111, and the reject outlet 63 are provided through the first side surface 123, and the first and second outlets 49 and 53 and the touch panel 17 are provided for the second side surface 124. However, this arrangement is merely an example.

Further, the banknote handling apparatus 100 is supposed to perform a single-kind banknote bundling processing, but this is only a non-limiting exemplary embodiment of the present disclosure. For example, the banknote handling apparatus 100 may perform a multiple-kind banknote bundling processing, in which banknotes of multiple different kinds are supposed to be bundled together, the two bundling stackers 4, 4 are supposed to stack banknotes of different kinds, and a predetermined number of banknotes stacked in each of the bundling stackers 4 are bundled by the bundling unit 9. That is, the first and second bundling stackers 4A and 4B may stack the banknotes of mutually different kinds.

The banknote handling apparatus 100 is supposed to handle loose banknotes including banknotes of multiple different denominations, but the banknotes to be handled by the apparatus are not always the banknotes of multiple different denominations. The banknote handling apparatus 100 may be configured to handle banknotes of a single predetermined denomination as well.

Also, the kind of the banknotes to be stacked in each stacker is supposed to be specified in advance. However, this is only a non-limiting exemplary embodiment. Alternatively, multiple different kinds of banknotes may be allocated to the respective stackers, for example, in the order in which those kinds are recognized by the recognition unit 3 since the banknotes started to be taken into the banknote handling apparatus 100. For instance, the first bundling stacker 4A may stack the kind of banknotes B that have been recognized by the recognition unit 3 for the first time. The second bundling stacker 4B may stack the kind of banknotes B that have been recognized by the recognition unit 3 for the second time. The first non-bundling stacker 5A may stack the kind of banknotes B that have been recognized by the recognition unit 3 for the third time. The second non-bundling stacker 5B may stack the kind of banknotes B that have been recognized by the recognition unit 3 for the fourth time.

Also, in the embodiment described above, the banknotes B are supposed to be transported in the direction parallel to their shorter edges, i.e., such that the direction parallel to their shorter edges corresponds with the transport direction. However, this is only an example and in no way limiting. Alternatively, the banknotes B may also be transported in the direction parallel to their longer edges, i.e., such that the direction parallel to their longer edges corresponds with the transport direction. Optionally, the transport direction may even be changed in the middle of the transport.

Furthermore, in the embodiment described above, the banknotes B are transported in the direction parallel to their shorter edges and introduced into the bundling stackers 4. Thus, the direction in which the guide 42 regulates the movement of the banknotes B is the direction parallel to the shorter edges of the banknotes B. Also, the removal direction of the banknotes B is the direction parallel to the longer edges of the banknotes B. However, this is only an exemplary embodiment. For example, if the banknotes B are transported in the direction parallel to their longer edges and introduced into the bundling stackers 4, the direction in which the guide 42 regulates the movement of the banknotes B may be the direction parallel to the longer edges of the banknotes B and the removal direction of the banknotes B may be the direction parallel to the shorter edges of the banknotes B.

Furthermore, in the embodiment described above, the stage 41 is supposed to move in the perpendicular direction, and the guide 42 is supposed to move in the horizontal direction. However, this is only an example. Alternatively, the stage 41 may also be configured to move in a direction which is tilted with respect to the perpendicular direction, and the guide 42 may also be configured to move in a direction which is tilted with respect to the horizontal direction.

INDUSTRIAL APPLICABILITY

As can be seen from the foregoing description, the present disclosure is useful for a paper sheet processing device.

DESCRIPTION OF REFERENCE CHARACTERS

100 Banknote Handling Apparatus (Paper Sheet Processing Device)
4A First Bundling Stacker (Stacking Unit)
4B Second Bundling Stacker (Stacking Unit)
41 Stage
42 Guide
49 First Outlet
B Banknote (Paper Sheet)
G Gap

The invention claimed is:

1. A paper sheet processing device comprising a stacking unit configured to stack paper sheets therein and including, a stage configured to support the paper sheets in their thickness direction; and a movable guide facing one side of the paper sheets and configured to regulate movement of the paper sheets in a predetermined regulation direction which is parallel to a surface of the paper sheets, the guide being arranged at a position where the guide overlaps the paper sheets stacked in the stacking unit in a side view, and while the paper sheets are being removed from the stacking unit, the guide moves in the regulation direction so as to be spaced apart from the one side of the paper sheets.

2. The paper sheet processing device of claim 1, wherein the regulation direction is one of two directions that are respectively (i) parallel to longer edges of the paper sheets and (ii) parallel to shorter edges of the paper sheets, and the stacking unit has an outlet configured to remove the paper sheets in a removal direction that is one of the two directions that are respectively (i) parallel to the longer edges of the paper sheets and (ii) parallel to the shorter edges of the paper sheets, the removal direction being different from the regulation direction.

3. The paper sheet processing device of claim 2, wherein the regulation direction corresponds with a transport direction in which the paper sheets are transported to the stacking unit.

4. The paper sheet processing device of claim 2, wherein the stacking unit is provided with a door configured to cover the outlet while the paper sheets are being stacked and to uncover the outlet while the paper sheets are being removed.

5. The paper sheet processing device of claim 4, wherein the door regulates the movement of the paper sheets in the removal direction while the paper sheets are being stacked.

6. The paper sheet processing device of claim 1, wherein the stage is movable to adjust a stacking space for the paper sheets by moving in the thickness direction of the paper sheets, and while the paper sheets are being stacked, as the paper sheets are stacked in increasing numbers, the stage moves in the thickness direction of the paper sheets toward one of two directions that expands the stacking space, and while the paper sheets are being removed, the stage moves in the thickness direction of the paper sheets toward that one direction that further expands the stacking space from its position while the paper sheets are being stacked.

7. The paper sheet processing device of claim 1, wherein the guide is arranged at a first position while the paper sheets are being stacked in the stacking unit and is arranged at a second position while the paper sheets are being removed from the stacking unit, and the paper sheet processing device further comprises a control unit configured to control the first position of the guide according to the kind of the paper sheets.

8. The paper sheet processing device of claim 1, further comprising a bundling unit configured to bundle the paper sheets stacked in the stacking unit.

9. The paper sheet processing device of claim 8, wherein the bundling unit is arranged horizontally alongside the guide.

10. The paper sheet processing device of claim 9, further comprising a transport unit configured to transport the paper sheets on the stage to the bundling unit, the guide is formed in a plate shape, and the guide is arranged at a position where the guide intersects with a vertical direction substantially at right angles while the paper sheets on the stage are being transported by the transport unit to the bundling unit.

11. The paper sheet processing device of claim 1, wherein the guide is arranged at a position where the guide overlaps lowermost ones of the paper sheets stacked in the stacking unit in the side view.

12. The paper sheet processing device of claim 1, wherein the regulation direction is a horizontal direction.

* * * * *